US010118421B2

(12) United States Patent
Teets et al.

(10) Patent No.: US 10,118,421 B2
(45) Date of Patent: Nov. 6, 2018

(54) PRINTER WITH SECURE TRAY

(71) Applicant: Teeco Associates, Inc., Norristown, PA (US)

(72) Inventors: Jeffrey Teets, Schwenksville, PA (US); Willard Teets, Norristown, PA (US)

(73) Assignee: Teeco Associates, Inc., Norristown, PA (US)

( * ) Notice: Subject to any disclaimer, the term of this patent is extended or adjusted under 35 U.S.C. 154(b) by 0 days.

(21) Appl. No.: 15/275,385

(22) Filed: Sep. 24, 2016

(65) Prior Publication Data

US 2018/0079234 A1 Mar. 22, 2018

Related U.S. Application Data

(60) Provisional application No. 62/398,511, filed on Sep. 22, 2016.

(51) Int. Cl.

| | |
|---|---|
| ***B41J 13/00*** | (2006.01) |
| ***B41J 13/10*** | (2006.01) |
| ***B65H 1/26*** | (2006.01) |
| ***G03G 15/00*** | (2006.01) |
| ***G07D 11/00*** | (2006.01) |

(52) U.S. Cl.

CPC ..... *B41J 13/103* (2013.01); *B65H 1/266* (2013.01); *G03G 15/6502* (2013.01); *G03G 15/6588* (2013.01); *G07D 11/0009* (2013.01); *G03G 2221/1654* (2013.01)

(58) Field of Classification Search

CPC ..... B41J 13/10; B41J 13/009; B41J 13/103; B41J 3/16; B41J 2/10; B65H 3/02; B65H 1/266; B65H 2405/1122; B65H 2405/1121

See application file for complete search history.

(56) References Cited

U.S. PATENT DOCUMENTS

| | | | |
|---|---|---|---|
| 3,084,757 | A | 4/1963 | Oishei |
| 3,848,907 | A | 11/1974 | Shiurila |
| 4,017,181 | A | 4/1977 | Komaba |
| 4,280,692 | A | 7/1981 | Hutchinson |
| 4,702,094 | A | 10/1987 | Peterson |
| 4,786,042 | A | 11/1988 | Stemmle |

(Continued)

OTHER PUBLICATIONS

How to Replace the Black and Color Imaging Kit on the Lexmark Printer/MFP, document available before filing date.

(Continued)

*Primary Examiner* — Juanita D Jackson

(74) *Attorney, Agent, or Firm* — Muskin and Farmer LLC

(57) ABSTRACT

A secure printer with a secure tray. Valuable paper can be put in the secure tray, such as prescription paper, stock certificates, etc. The secure printer can lock the secure tray so that the secure tray cannot be removed from the secure printer or printed to. A wireless fob can be used to unlock the secure printer and thus enable removal of the secure tray from the secure printer and/or enable printing to the secure tray. A latch can be retracted and extended into a notch in the secure tray. When the latch is extended it would lock the secure tray from removal. A processor can control when to retract and extend the latch. A standard printer can also be converted to a secure printer by installing some components including a latch assembly, a processor board, and a detectable object on a side of the secure tray.

33 Claims, 23 Drawing Sheets

(56) References Cited

U.S. PATENT DOCUMENTS

| | | | | |
|---|---|---|---|---|
| 5,157,448 | A | 10/1992 | Lang | |
| 5,774,058 | A | 6/1998 | Henry | |
| 6,107,934 | A | 8/2000 | Andreou | |
| 6,400,462 | B1 | 6/2002 | Hille | |
| 7,389,985 | B2 | 6/2008 | Schaefer | |
| 7,697,150 | B2 | 4/2010 | Smith | |
| 7,753,356 | B2 | 7/2010 | Rowe | |
| 7,755,794 | B2 | 7/2010 | Martin | |
| 7,761,907 | B2 | 7/2010 | Osaka | |
| 7,805,569 | B2 | 9/2010 | Endo | |
| 8,162,228 | B2 | 4/2012 | Yamamoto | |
| 8,220,297 | B2 | 7/2012 | Palumbo et al. | |
| 8,482,413 | B2 | 7/2013 | Martin | |
| 8,511,120 | B2 * | 8/2013 | Cahill | B41J 13/0027 340/5.51 |
| 8,542,377 | B2 | 9/2013 | Yamamoto | |
| 8,608,154 | B2 | 12/2013 | Yamada | |
| 2005/0243118 | A1 | 11/2005 | Ward | |
| 2009/0328159 | A1 | 12/2009 | Luo | |
| 2010/0157378 | A1 | 6/2010 | Cole | |
| 2012/0222458 | A1 | 9/2012 | Avganini | |
| 2013/0250845 | A1 | 9/2013 | Greene | |
| 2017/0078508 | A1 | 3/2017 | Amico | |

OTHER PUBLICATIONS

Lexmark locking paper trays, https://www.argecy.com/2438 , appeared before filing date.
"World's Most Secure Printers", distributed by HP, Apr. 2016.
KEELOQ with Advanced Encryption Standard (AES) Receiver/Decoder, 2011.
LM 1872 Radio Control Receiver/Decoder, National Semiconductor, 1989.
"Printer Device Security", https://web.archive.org/web/20161216133631/http://www8.hp.com/us/en/solutions/business-solutions/printingsolutions/devicesecurity.html, archived on Dec. 16, 2016 but applicant submits this was published before filing date.
Lexmark Service Manual, published 2013, pp. 317-318.
Screen shots from: Youtube, https://www.youtube.com/watch?v=GxiZHUwP5ZU, "How to refill your Lexmark CS310dn, CS410dn, CS410dnw, CS510de, CS510dew and related laser printers", , published Apr. 11, 2015.
Lexmark Service Manual, published 2013.
(author unknown), "Troy MICR 3035 MFP", 2013.
(author unknown), "Hit Print Intelligently", 2011.
Troy SecurePro Jet Printers, 2013.
Troy SecureRX Solutions, 2012.

* cited by examiner

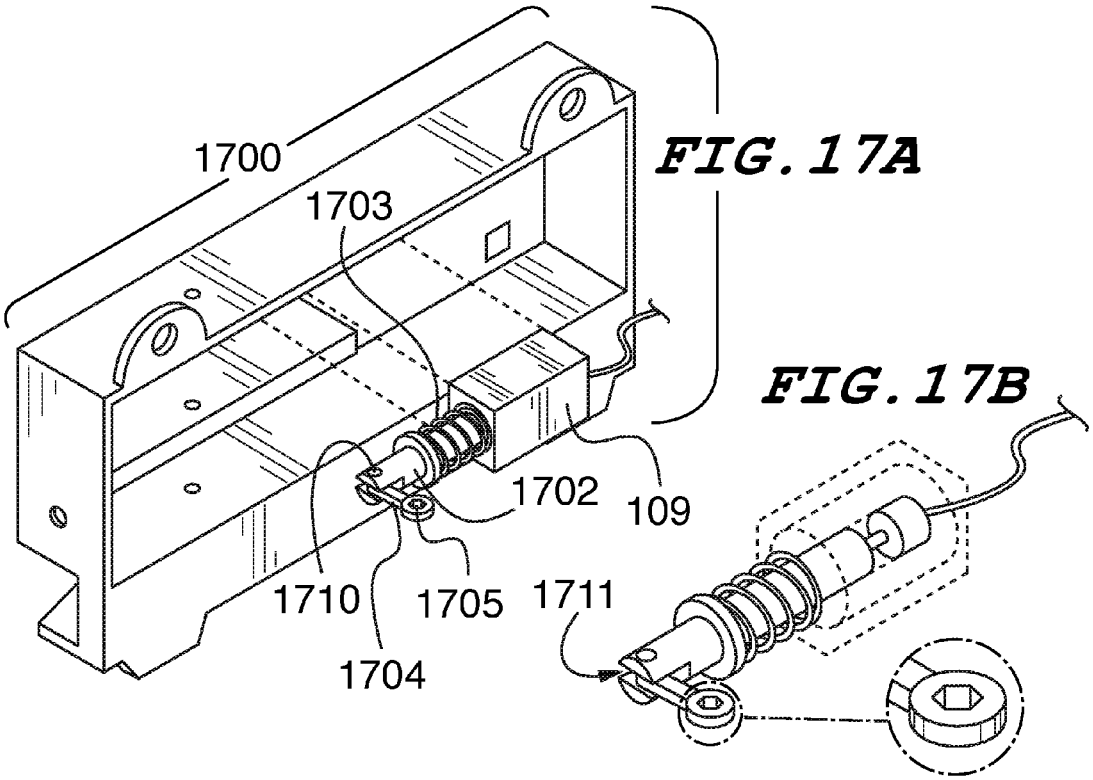
FIG. 17A
FIG. 17B
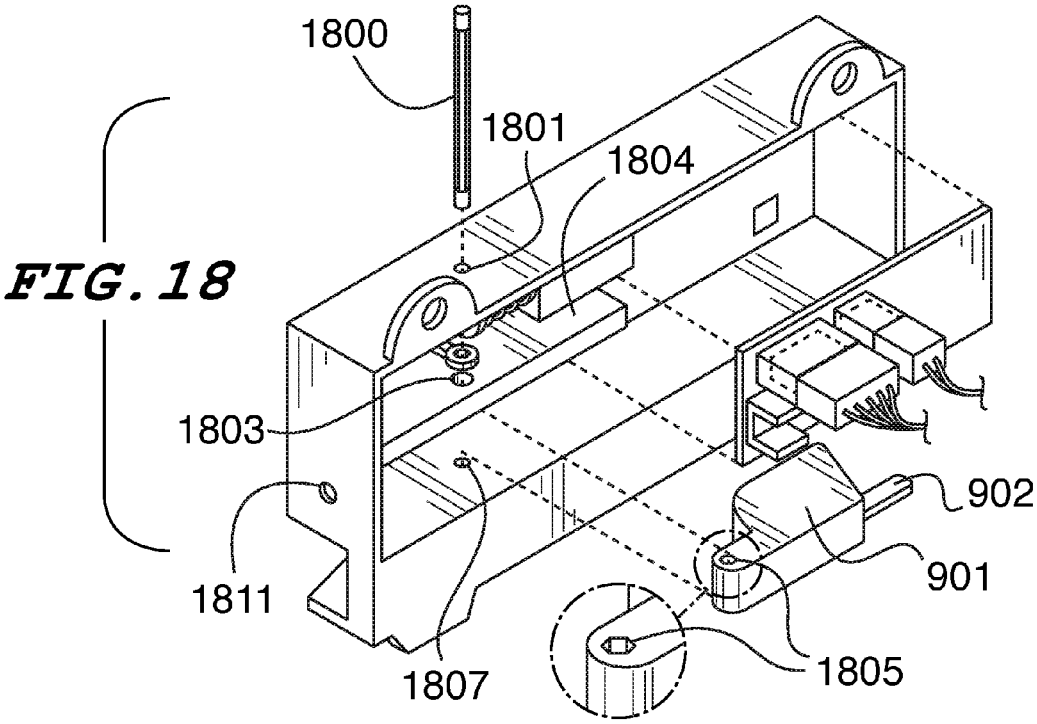
FIG. 18

PRINTER WITH SECURE TRAY

CROSS REFERENCE TO RELATED APPLICATIONS

This application claims benefit to U.S. provisional application 62/398,511, which is incorporated by reference herein in its entirety.

BACKGROUND OF THE INVENTION

Field of the Invention

The present general inventive concept is directed to a method, apparatus, and computer readable storage medium directed to a method, apparatus, and computer readable storage medium to implement a printer which has a secure tray in order to keep valuable printable media safe.

Description of the Related Art

Printers can print on valuable paper. Valuable paper media can be, for example, prescription paper, stock certificates, transcript paper, etc. If someone were to be able to take this valuable paper they could do numerous illegal and dangerous things (such as write fraudulent prescriptions, falsify transcripts, etc.)

In order to address this solution, printers have been designed to include a physical lock and key for a printer tray. Thus, the only way the tray can be opened is by having the physical key in order unlock the tray and open it. However, blank media can also be extracted from a locked cassette by printing a blank page from the computer or pattern generator. Blank media can also be created by blocking the laser beam from striking the image unit and generating a test page, engine print test, and any other test or print job.

SUMMARY OF THE INVENTION

It is an aspect of the present invention to provide an improved method, system, and computer readable storage for keeping valuable paper secure.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 17A is a drawing of a latch assembly and its solenoid, arm and spring, according to an embodiment;

FIG. 17B is an enlarged view of the solenoid and linkage, according to an embodiment;

FIG. 18 is a drawing of the latch assembly and a latch arm axle, according to an embodiment;

DESCRIPTION OF THE PREFERRED EMBODIMENTS

Figure 1:
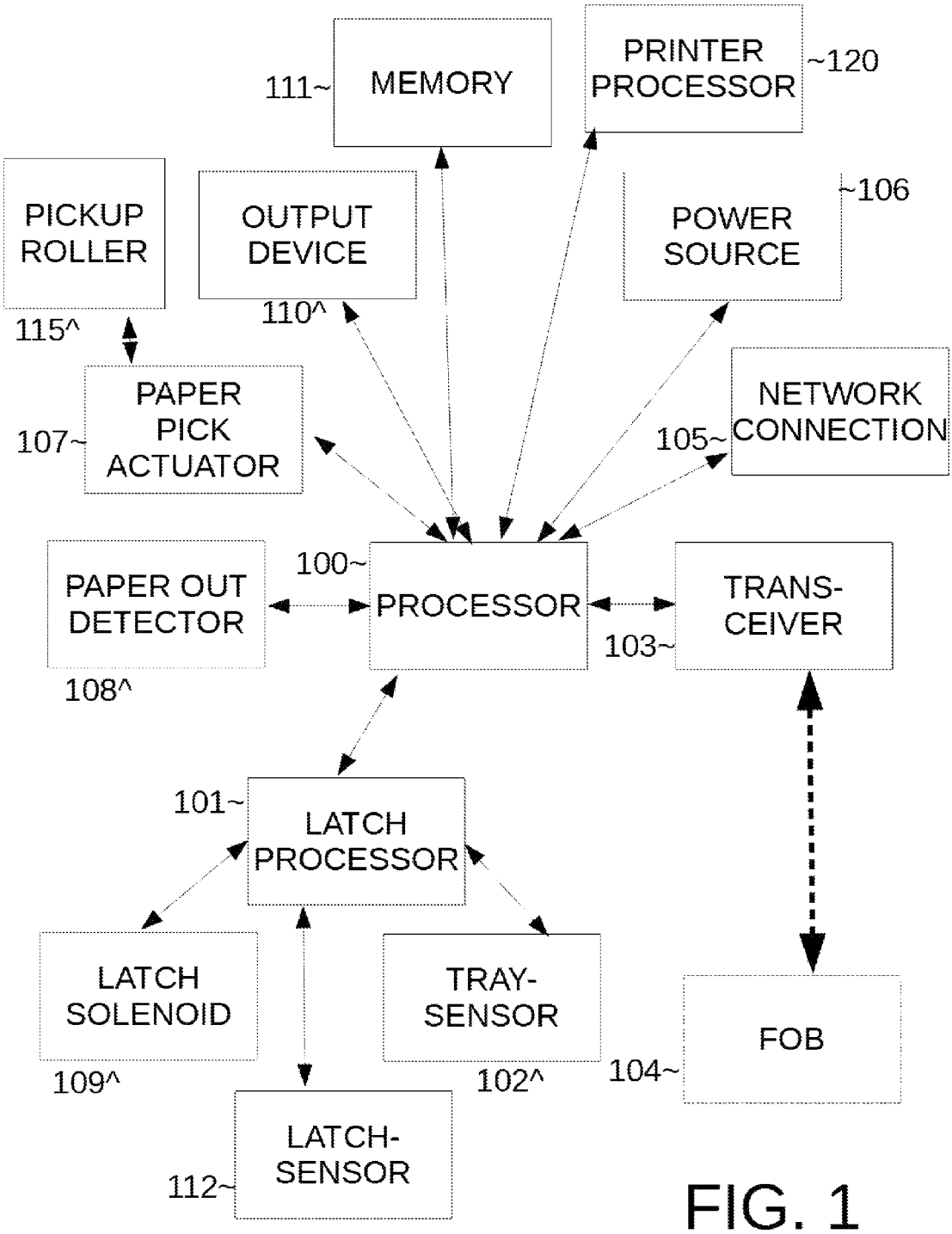
FIG. 1 is block diagram illustrating components of a secure tray printer, according to an embodiment.

Reference will now be made in detail to the presently preferred embodiments of the invention, examples of which are illustrated in the accompanying drawings, wherein like reference numerals refer to like elements throughout.

The present inventive concept relates to a secure tray printer (also referred to as secure printer). "Printer" as used herein also refers to a secure printer unless a standard printer is being referred to, a standard printer being a prior art printer that does not have any mechanism to safeguard paper in a tray from theft). A printer (whether standard or secure) is a device that can print (via inkjet or laser) desired text and images to paper stored in the printer. Note that while "printer" is used herein, this can also refer to any image forming device which can also include copiers and multi-function machines (which can fax, scan, print, etc.) A secure tray printer can secure valuable paper in its tray (also referred to as cassette) so it cannot be removed by an unauthorized user. In an embodiment, a latch controllable by a processor can lock the secure tray inside the printer (by extending the latch into a notch in the secure tray) and the secure tray cannot be removed unless the latch is retracted. Thus, the secure printer can keep valuable paper secure inside a secure tray in the printer without it being printed on or physically removed by an unauthorized user.

Note that the inventive concept described herein has two embodiments. The first is a stand-alone secure tray printer which is manufactured for this purpose (a "manufactured secure tray printer"). The second embodiment is a converted standard printer, that is, a standard printer can be converted to a secure tray printer by installing particular hardware as described herein ("conversion embodiment").

The printer can have numerous trays, a secure tray which is used to house the valuable paper and thus the printer locks and unlocks access to the secure tray. The printer can also have other, unsecure trays, which would not have the locking functionality and can have standard paper inside them. While the secure tray can be locked and prevented from printing to (or removing the secure tray), the unsecure trays can still be fully accessible to the user (can be printed to or removed) without regard to which mode the printer is in.

There are numerous modes the printer can be in. Different modes have different functionality and have different triggers which will initiate respective modes. At any one point in time, the printer can be in only one mode (the current mode).

A refuse mode is a mode which does not allow for media to be drawn from the secure tray (the tray that has the valuable paper) and does not allow for removal of the secure tray. The refuse mode comes in two sub-modes, an error refuse mode and a non-error refuse mode. Both the error refuse mode and the non-error refuse mode have the same functionality, that is, they do not permit printing on the valuable paper nor removal of the secure tray, but they both do allow for printing on other trays in the printer that are not the secure tray. The non-error refuse mode is the default mode when the printer is powered on and no other error is detected. The error refuse mode means the printer is in the refuse mode but an error was detected. The difference between the two modes is that the accept mode (to be discussed below) cannot be triggered from the error refuse mode until the error is corrected. However, the accept mode can be triggered from the non-error refuse mode because there was no error detected.

In the refuse mode (the "refuse mode" refers to both the non-error refuse mode and the error refuse mode), a latch remains locked (extended) so that the secure tray cannot be removed. Because the latch extends into a notch on a side of the secure tray, the secure tray cannot be removed from the printer. The secure printer tray also cannot be printed to. In the refuse mode, an indicator LED will illuminate and a status message will be sent to the operator's computer. When the printer is in refuse mode it will not permit media to be fed from the security cassette (tray). This will be accomplished by logically disabling the pickup feed mechanism.

A paper pick actuator is a device that can activate or physically engage a motor that would drive paper out of the secure tray. For example, the paper pick actuator can be a paper pickup solenoid which when energized, engages a pickup roller with a main drive motor. Each tray in the printer would typically have its own pickup roller (activated by their own respective paper pick solenoid) which are all driven by a main drive motor. By activating a paper pickup solenoid this engages the respective pickup roller with the main driver motor (gear train) and enables paper to be picked out of the respective tray. Thus, the paper pickup solenoid for the secure tray can be disabled so that that paper from the secure tray could not be removed from the secure tray and be printed on. In an embodiment, a secure tray can also have its own dedicated motor and the paper pick actuator would be a switch that would activate the dedicated motor for the secure tray. As such the paper pickup actuator can be controlled so that paper can only be removed from the secure tray by the printer when the printer has authorization to do so (e.g., in the proper mode).

In the refuse mode (refers to both the no error refuse mode and the error refuse mode), the paper pick actuator would disable operation of the pickup roller so that paper cannot be picked out of the secure tray by the secure printer. However, the pickup rollers for the other (non-secure) trays are always operational and those pickup rollers can function normally thus enabling printing out of the non-secure trays.

The paper pick actuator 107 (upon direction by the processor 100) can disable and enable the pickup roller clutch assembly 115 (which is for the secure tray). This can be done in numerous ways. For example, the paper pick actuator 107 can switch on/off a motor that controls the pickup roller 115 (also referred to as paper pickup roller). Alternatively, the paper pick actuator 107 can lock/release a clutch which will engage/disengage the pickup roller 115 from the main gear drive assembly which drives the pickup roller 115. A main drive motor provides rotational energy to the main gear assembly of a printer (or other image forming apparatus) which drives the pickup roller 115, paper feed and imaging process. The rotation of the paper pickup roller 115 is engaged and disengaged by use of a solenoid controlled clutch assembly. When this solenoid (the pick actuator 107 can be this solenoid) is energized it will permit the pickup roller clutch assembly (and hence the pickup roller 115) to engage the main gear assembly, providing rotational motion to the pickup roller 115. As the pickup roller 115 rotates it pulls a sheet of print media out of the paper tray/cassette into the rotating feed rollers that carry it through the image forming apparatus. The pickup roller solenoid (pick actuator 107) can then be de-energized which stops the rotation of the pickup roller 115 by activating the clutch assembly resulting in the pickup roller 115 to become disengaged from the main gear drive assembly. As such, controlling (e.g., energizing and de-energizing) of the pick actuator 107 (which can be the pickup roller solenoid) can enable or prevent the pickup roller 115 from operating. Since the processor 100 can control the pick actuator 107 (which can enable/disable the roller 115 which pulls paper out of the secure tray), the processor 100 can allow or prevent from printing to the secure tray. Pickup rollers, the clutch assembly and how it engages the main gear assembly, and pickup roller solenoids are known in the art.

In the converted standard printer embodiment, a signal from the paper out detector (e.g., a photo interrupter which detects whether there is any paper left) on the secure tray is intercepted and changed to emulate either a paper out error or no paper out error. With a paper out error (for the secure tray), the printer processor 120 would not print to the secure tray. Without a paper out error (for the secure tray), then the printer processor 120 proceed to print to the secure tray (unless some other error stopped the printing). Most standard printers come with a different paper out detector for each tray so that they would avoid trying to print to trays without paper. Thus, by controlling a signal coming out of the paper out detector, the processor 100 can provide an extra layer of security by emulating a paper out signal (error) when the printer should not print to the secure tray (e.g., in the refuse mode). When the secure printer is in a mode which allows printing (e.g., the accept mode) then the controller processor would not generate a paper out signal (error) so the secure printer would proceed to print to the secure tray. Note however, that if there is really a paper out error in the secure tray but the printer is in a mode which allows printing (e.g., the accept mode), then the processor 100 still would not allow printing to the secure tray since there is no paper in the secure tray (the paper out error would be maintained and transmitted to the printer processor 120). Thus, the processor 100 still receives a valid signal from the paper out detector in the secure tray but can change the signal to another signal (e.g., there is no paper out error in the secure tray but would generate a paper out error in the secure tray for the printer processor 120) to prevent printing to the secure tray in certain modes. The processor 100 would only enable printing to the secure tray if it was in a mode which allows printing (e.g., the accept mode) and there really is paper in the secure tray (there is no paper our error coming from the paper out detector in the secure tray).

Note that a converted printer (the conversion embodiment) controlling the signal coming out of the paper out detector and also controlling the signal to the paper pick actuator 107 provides additional levels of security. For example, if the secure printer controlled the signal to the paper pick actuator 107 but did not control the paper out signal, then if a user tried to print to the secure tray the printer processor 120 might detect that no printing has occurred (even though printing was attempted) and thus generate a paper jam error (assuming that a paper jam must be causing the pickup roller for the secure tray not to operate). A paper jam error might disrupt all printing. On the other hand, if the secure printer controlled the paper out signal but not the paper pick actuator 107, then it might be conceivable someone could hack into the printer processor 120 and override a paper out error and still print to the secure tray even though there is technically a paper out error that has been generated therein. Thus, by controlling both the paper out signal and the paper pick actuator 107 the processor 100 can maintain a high level of security over printing to the secure tray.

The output device 110 connected to the controller processor can comprise a plurality of LEDs which indicates the mode. In the refuse mode the output device 110 can light up a red LED, indicating that the printer will not print from the secure tray.

From the refuse mode, the printer can then be changed to the accept mode if the proper keys are pressed on the fob. From the refuse mode, if a hard error (to be discussed below) is generated then mode can also change to the tamper evident mode. From the refuse mode, if the printer is powered off then the mode can change to the deep sleep mode.

Another mode is the accept mode. The accept mode allows for printing on the secure tray. The green LED on the output device 110 will be illuminated. The paper pick actuator 107 for the secure tray is enabled to allow paper to be picked up out of the secure tray (e.g., by a pickup roller). In the conversion embodiment, the photo interrupter for the secure tray (the paper out sensor) is allowed to operate normally. Note that in the accept mode, the secure tray can still not be removed as the latch remains locked (extended).

Note that the secure printer cannot enter the accept mode if any error is detected. The secure printer must be in the accept mode in order to enter the latch retract mode which allows removal of the secure tray.

The secure printer will remain in the accept mode until one of the following triggers occur: 1) after four hours (or any other predetermined amount of time) of being in the accept mode; 2) the user presses the red button on the fob, which places the secure printer into the refuse mode; 3) an error is detected on the secure printer which will then trigger the appropriate error mode (e.g., the error refuse mode or the tamper evident mode); 4) the secure printer is powered off in which the secure printer will enter the deep sleep mode.

Thus, in the accept mode the user can print to the secure tray (and hence can print on the valuable paper stored in the secure tray), however the user cannot remove the secure tray.

Another mode is the latch retract mode. The latch retract mode enables the secure tray to be removed by retracting the latch which locks the secure tray inside the secure printer. The secure printer must be in the accept mode before the secure printer can enter the latch retract mode. The latch retract mode can be entered by pressing the yellow button on the fob for one second (or other button/combination). Once the request to enter the latch retract mode is confirmed by the controller processor, a signal is sent from the controller processor to the latch processor to energize the latch solenoid (thereby retracting the latch and allowing the secure tray to be removed).

When the latch is retracted a yellow LED on the output device 110 can blink thereby indicating that the secure tray can be removed from the secure printer. In the latch retract mode, the secure tray can be printed to (e.g., the paper pick actuator 107 enables the pickup roller to function).

The latch will remain retracted for a maximum of 30 seconds (or other predetermined amount of time) or until the secure tray has been detected as being removed (by a tray sensor). Once the tray sensor 102 has detected that the secure tray has been removed, then the latch solenoid is de-energized which returns the latch to the extended (locked) position. This would allow the secure tray to be reinserted into the secure printer but then it cannot be thereafter removed (without re-activating the latch retract mode). The latch is such that when retracted it enables the secure tray to be removed and re-inserted, but when the latch is extended then it can only enable the secure tray to be re-inserted but not removed. The latch only has two states, extended and retracted (of course while the latch is being extended or retracted the latch may technically be in an intermediate state but we are not concerned with that).

The secure printer will remain in the latch retract mode until one of the following occurs: 1) the 30 seconds (or other amount of time expires); 2) printer is powered off.

Another mode is the tamper evident mode. The tamper evident mode is triggered (when the printer is any mode) when a "hard error" is detected, and all three LEDS on the output device 110 will flash. A hard error is where any of the connectors to the controller processor are detected as being disconnected (and hence someone is tampering with the secure printer). For example, any of the following cables/connectors, if either end is unplugged, would cause a hard error: the cable connecting the controller processor to the latch assembly, the cable connecting the controller processor to the paper out sensor; the cable connecting the controller processor to the paper pick actuator 107, the cable connecting the power button on the printer to the controller processor, and any other cable connected to any electrical part inside (or outside) of the printer.

For example, someone might attempt to disable the secure printer and create a blank test print (or otherwise print a blank sheet of valuable paper form the secure tray).

In the tamper evident mode, the printer will be unable to be placed into the accept mode (and hence the printer also cannot be placed into the latch release mode). The printer can still print to the non-secure trays.

The secure printer will remain in the tamper evident mode until a tamper evident release sequence is successfully performed by the user. The tamper evident release sequence is analogous to a "combination lock" which when correctly performed would return the secure printer to the refuse mode. In order to complete the tamper evident release sequence, the user will have to contact a support group to receive the correct sequence of keys to press on the fob. The user can be instructed to press a sequence of keys (e.g., hold both the green and red buttons on the fob for one second), and then the support staff can instruct the user to press three (or any number) of different button sequences on the fob to release to secure printer from the tamper evident mode to the refuse mode. The sequence of buttons can be randomly determined by the printer and/or a computer on the support staff's side and communicated between the printer and the support staff via the internet. Once the user correctly completes the first button sequence, then a new randomly selected button sequence is required, and when the user correctly completes the second button sequence, then a third randomly selected button sequence is required. When all three sequences (levels) are successfully completed, then the printer enters the refuse mode.

Another mode is the deep sleep mode. The deep sleep mode is when the printer is powered down, although when powered back on the secure printer will enter the no error refuse mode. Note however, that if the secure printer is in the tamper evident mode, then powering it down into the deep sleep mode will not remove the tamper evident mode and upon powering the printer back up the printer will remain in the tamper evident mode. In another embodiment, the secure printer would not enter the deep sleep mode in the tamper evident mode (the three LEDs would remain flashing) and if the secure printer is unplugged, upon it being plugged back in it would immediately resume the tamper evident mode. The printer cannot print anything at all to any tray (and of course the secure tray remains locked) in the deep sleep mode. Note that in the deep sleep mode the latch remains in the extended (locked) position and hence the secure tray cannot be removed.

Table I below represents a chart of the different modes (in the first column) and the signals that would be generated for that mode.

TABLE I

| Mode | Paper Pick Actuator | Paper Out Signal | Latch Solenoid |
|---|---|---|---|
| Deep Sleep Mode | pickup roller disabled | paper out error | not energized |
| Error refuse mode | pickup roller disabled | paper out error | not energized |
| No error refuse mode | pickup roller disabled | paper out error | not energized |
| Accept mode | pickup roller enabled | no paper out error | not energized |
| Latch retract mode | pickup roller enabled | no paper out error | energized |

Thus, for example, in the deep sleep mode, the paper pick actuator disables the pickup roller for the secure printer tray so that no paper can be picked up from the secure tray. In the deep sleep mode the controller processor generates a paper out error, and the latch solenoid is not energized so that the latch remains in the retracted position.

FIG. 1 is block diagram illustrating components of a secure tray printer, according to an embodiment.

A processor 100 (also referred to as the controller processor) can be a microprocessor and any associated structure (e.g., power supply, bus, cache, etc.) Processor 100 can also be referred to as the controller processor because this processor drives a controller enabling the secure printing system. In the conversion embodiment, the secure printer may have another processor (a printer processor 120) which controls printing functions such as controlling the print head/laser, decoding the print files, etc., but these functions are separate from the operations related to securing the secure tray. In the manufactured secure tray printer embodiment, the same processor 100 in addition to carrying out the operations related to securing the secure tray can also carry out the printing functions or these can also be controlled by a separate processor. The printer processor 120 can be connected to a printing mechanism, which is the mechanism that enables a printer to print on paper and can comprise things such as the print heads, motors to move the print heads, motor which moves the paper, laser assembly, etc. In the conversion embodiment, the processor 100 (and its printed circuit board) can be installed the original printer in order to implement the secure functions described herein. The printer processor 120 can receive and issue electronic commands, such as a print command, which instructs the printing mechanism (e.g., print heads, etc.) to print images and/or text which are associated with the print command. A laser or LED assembly can be used to create the image on the photoconductive surface.

The processor 100 can be connected to a latch solenoid 109. The processor 100 can control the latch solenoid 109 and energize the latch solenoid 109 and cause it to retract the latch from the extended position. Typically, the latch is spring-loaded and would naturally be in the extended position. In the extended position, the secure tray cannot be removed from the secure printer, although the secure tray that is already removed can be inserted back into the secure printer through the latch. This is because when the latch is extended it can still be manually pushed back into the retracted position by motion going into the secure printer, however once extended and behind a notch in the secure tray, the secure tray cannot then be removed in the direction going out of the secure printer past the extended latch without the latch being retracted first. Typically, after a predetermined amount of time (e.g., 30 seconds) the energized latch solenoid 109 (which causes the latch to be in the retracted position (unlocked)) would then automatically de-energize and thereby cause the latch to extend.

The processor 100 can also be attached to a latch processor 101. The latch processor 101 is a microprocessor which controls and communicates with the latch assembly (latch solenoid 109, latch sensor 112) and the tray sensor 102. The processor 100 can selectively control the latch processor 101 to cause a retract and extend (default position) of the latch, meaning at any time the processor 100 can command the latch to retract (by energizing the latch solenoid) and at any time the processor 100 can command the latch to extend (by not energizing the latch solenoid which utilizes a spring to naturally drive the latch back to the extended position).

The latch sensor 112 can be a photo interrupter which checks for a light signal to pass from a light source to the photo interrupter. If the light source is blocked (interrupted) then the photo interrupter detects that the signal is blocked but if the light is detected then the photo interrupter detects that the signal is not blocked. Thus, the latch sensor 112 can detect whether the latch is extended or retracted by detecting whether the latch arm flag is present or not, the latch arm flag being connected to (and hence moving along with) the latch. When the latch sensor 112 detects that the latch is in the retracted position (by the latch arm flag being in the retracted position) it can cause a yellow LED to light on the output device 110 thus indicating that the latch is retracted and the secure tray can be removed.

The latch processor 101 can also be connected to a tray sensor 102. The tray sensor 102 can be an RFID detector (with an RFID marker on the secure tray), or a hall sensor (with a magnet on the secure tray), or any other such locating mechanism. The tray sensor 102 can detect the presence and absence of the secure tray in the printer (in the appropriate drawer of the secure printer). For example, the secure tray can have a magnet embedded on the side and the tray sensor on the secure printer (in the appropriate location to detect the magnet when the secure tray is inserted into the printer) can detect the presence and absence of the magnet thereby determining whether the secure tray is loaded into the secure printer or not. Alternatively, the secure tray can have a RFID marker on it which can be read by a RFID sensor on the secure printer so that the secure printer can detect the presence and absence of the RFID marker thereby determining whether the secure tray is loaded into the secure printer or not. The tray sensor 102 (on the printer) and the detectable object (e.g., magnet, RFID market, etc.) would be aligned so that when the secure tray is inserted into the printer (in its proper location) then the detectable object would align along with the tray sensor 102 so the tray sensor 102 would detect the presence of the detectable object. If the detectable object is not detected by the tray sensor then it would be determined that the secure tray is not present.

Note that the processor 100 communicates with the latch processor 101 which in turn communicates with the latch solenoid 109, the latch sensor 112, and the tray sensor 102. Thus, the processor 100 can indirectly communicate with the latch solenoid 109, the latch sensor 112, and the tray sensor 102 via the latch processor 101. The processor 100 can be considered the "main" processor.

The processor 100 can also be connected to a transceiver 103 which is configured to wirelessly communicate to and from the fob 104. The wireless communications between the transceiver 103 and the fob 104 can be encrypted so that a hacker cannot try to intercept the wireless signals and send commands the secure printer (e.g., change modes).

The processor 100 can also be connected to a network connection 105 which can communicate with any computer communications network, such as the Internet, a LAN, WAN, etc. The processor can also be connected to an appropriate power source 106. The power source 106 also includes a printer power switch in which the user turns on/off the printer. The processor 100 can also be connected to an output device 110 which can be a display of three (or any other number) of LEDs (can be flashing or solid) indicating the current printer status. The output device 110 can also be any other output device, such as an LCD, touch screen, etc. Some examples of light patterns for soft errors are as follows: fast flash red and flashing yellow=failed communication to latch board; fast flash red and flashing green=the latch board photo interrupter detects that the latch arm is retracted preventing the cassette from being secured; fast flash redand solid yellow=the magnet or RFID is not detected by their corresponding reader; fast flash red and solid green=the latch arm is retracted and the magnet or RFID is not detected; fast flash red and solid green and yellow=latch arm doesn't retract when commanded. A soft error is created when and error is detected that can be corrected by the operator. A corresponding light pattern will be displayed to enable the operator in the correction of the error. A soft error will prevent media from being drawn from the security cassette.

The processor 100 can also be connected to a paper pick actuator 107 used for the secure tray. Note that typically a printer with multiple trays would have a dedicated pickup roller for each tray (a pickup roller is what pulls a sheet of paper out of each tray so the sheet of paper can be printed on). A main drive motor is the main motor on the printer which drives each of the pickup rollers. A gear train is used to engage the main drive motor with different pickup rollers (only one pickup roller can be active at any one time). A paper pickup solenoid is used to engage/disengage a particular pickup roller with the main drive motor. There is one paper pickup solenoid for each paper tray. Thus, the paper pickup solenoid referred to herein is the solenoid which engages the pickup roller 115 for the secure tray with the main drive motor. This paper pickup solenoid is controlled by the controller processor 100 so that paper can be prevented from being picked up by the pickup roller from the secure tray unless the secure printer is in the proper mode. In this way, by deactivating the paper pickup roller for the secure tray then a user cannot print a blank page from the secure tray. Note that in an embodiment, a paper tray may have its own motor. In this case, there would be an activator of this motor (e.g., solenoid, switch, etc.) which can enable/disable operation of this motor. This can be utilized in the same way as controlling the pickup paper solenoid, that is, by controlling the ability to pick paper out of the secure tray, unless the secure printer is authorized (e.g., in the proper mode), the pickup roller for the secure tray will be prevented from being operational by the controller processor. The paper pick actuator 107 is the term used to refer to any apparatus that can control the ability of the pickup roller for the secure tray to pick paper out of the secure tray. The paper pick actuator 107 be, for example, a paper pickup solenoid for the secure tray which can be energized/de-energized to engage/disengage the secure tray pickup roller from operation by the main dive motor. The paper pick actuator 107 can also be a switch which enables/disables a motor which operates a pickup roller for the secure tray. The paper pick actuator 107 can also be any solenoid, switch, activator, etc. which can enable/disable the secure tray pickup roller operation which picks up a sheet of paper out of the secure tray. Note that any solenoid that can be used as the paper pick actuator 107 is different from the latch solenoid 109. Thus, in an embodiment of the conversion embodiment, the printer processor 120 no longer has direct access to the paper pick actuator 107 as it not is now controlled by the processor 100.

The processor 100 (also referred to as controller processor) is connected to the paper pick actuator 107 so that the processor 100 can control (e.g., enable, disable) the paper pick actuator 107 so that in certain modes the secure tray pickup roller 115 would be disabled (no paper can be removed from the secure tray and hence no printing) while in other modes the secure tray pickup roller 115 would be enabled (paper can be removed from the secure tray hence printing is allowed). Note that in a mode which does not enable printing from the secure tray (e.g., the refuse mode), other trays can still be printed to normally. Thus, paper pick actuator 107 only refers to the paper pick actuator 107 for the secure tray, while other paper pick actuators can exist for non-secure trays on the secure printer which can operate normally even when the printer is disabled from printing to the secure tray.

The processor 100 can also be connected to a non-transitory memory 111 (e.g., RAM and/or ROM and/or nonvolatile storage such as a disk drive, etc.) which can store data used by the processor. For example, the RAM can store data regarding the mode(s) the printer is currently in, data regarding time elapsement, programs to implement the methods herein, etc. The memory 111 can also store computer readable instructions (programs) which can instruct the processor 100 to implement any and all of the methods described herein. Note that the processor 100 can be, for example, a PIC (programmable integrated circuit) which can read its instructions from a ROM and/or RAM and can execute programs compiled in the C+ language (or other languages). The program can receive any inputs from any of the components described herein, process them, and determine the outputs, and transmit the outputs to the respective components. The stored program which is executed by the processor 100 can be programmed to implement all of the functions described herein (e.g., implementing all of the different modes, communicating with the fob, etc.) Communication connections exist between the processor 100 and any other component it needs to communicate with, whether illustrated in the Figures or not. Of course all processors described herein receive their needed power supply.

In the conversion embodiment, the processor 100 is also connected to a paper out detector 108, so the processor 100 can "hijack" or intercept the paper out signal. A paper out detector can exist on each tray which detects whether there is paper present and detects when there is paper absent (by the absence and presence of a light signal, respectively). When the secure printer is in a mode which does not allow printing from the secure tray, then the processor 100 can emulate a paper out signal so that the secure printer would be unable to print using the secure tray. When the secure printer is in a mode which does allow printing from the secure tray, then the processor 100 would not interfere with the paper out signal so that the secure printer can print normally from the secure tray.

The processor 100 can also be connected to a printer processor 120. The printer processor 120 can be part of the main printer engine that controls the overall functions of the printer (e.g., controlling the print heads, decoding the print file, communicating on the wireless network, etc.) In the conversion embodiment, the processor 100 can be connected to the printer processor 120 so the processors can communicate and the processor 100 can request certain functions from the printer processor 120, such as controlling operation of the paper pick actuator 107 (e.g., disabling/enabling the pickup roller for the secure tray), running initialization routines, etc. In the manufactured secure tray printer, in one embodiment, the processor 100 would still exist separate from the printer processor 120 as in the conversion embodiment. In the manufactured secure tray printer, in another embodiment, the processor 100 can also take on all of the functions of the printer processor 120 so that there is no need for a separate printer processor 120, in other words all of the main printer functions plus the security features can all be implemented by processor 100 (in essence merging the functions of the processor 100 and the printer processor 120 together). The printer processor 120 can be considered the "printer engine" and all standard printers would typically have such a printer processor 120 to direct all functions of the printer. The logic that is used to operate the mechanical and electrical devices of the image forming apparatus is commonly referred to as the Engine Components such as, motors, fans, laser scanner assemblies and voltages are controlled by the engine. The engine also monitors signals that detect movement of the fans, motors, presences of the laser, temperature of the fuser assembly and more. During the printing process the engine will, check for errors, bring the fuser assembly up to its operating temperature, ensure that the scanner is running at its correct speed, operate the motors, feed the media through the image forming apparatus, operate the high voltage and low voltage voltages, control the laser or LED assembly to create the image on the photoconductive surface, monitor the paper movement and eject the paper from the image forming apparatus. During the printing process the engine will, check for errors, bring the fuser assembly up to its operating temperature, ensure that the scanner motor is running at its correct speed, operate the motors, feed the media through the image forming apparatus, operate the high voltage and low voltage voltages, control the laser or LED assembly to create the image on the photoconductive surface, monitor the paper movement and eject the paper from the image forming apparatus.

Figure 2:
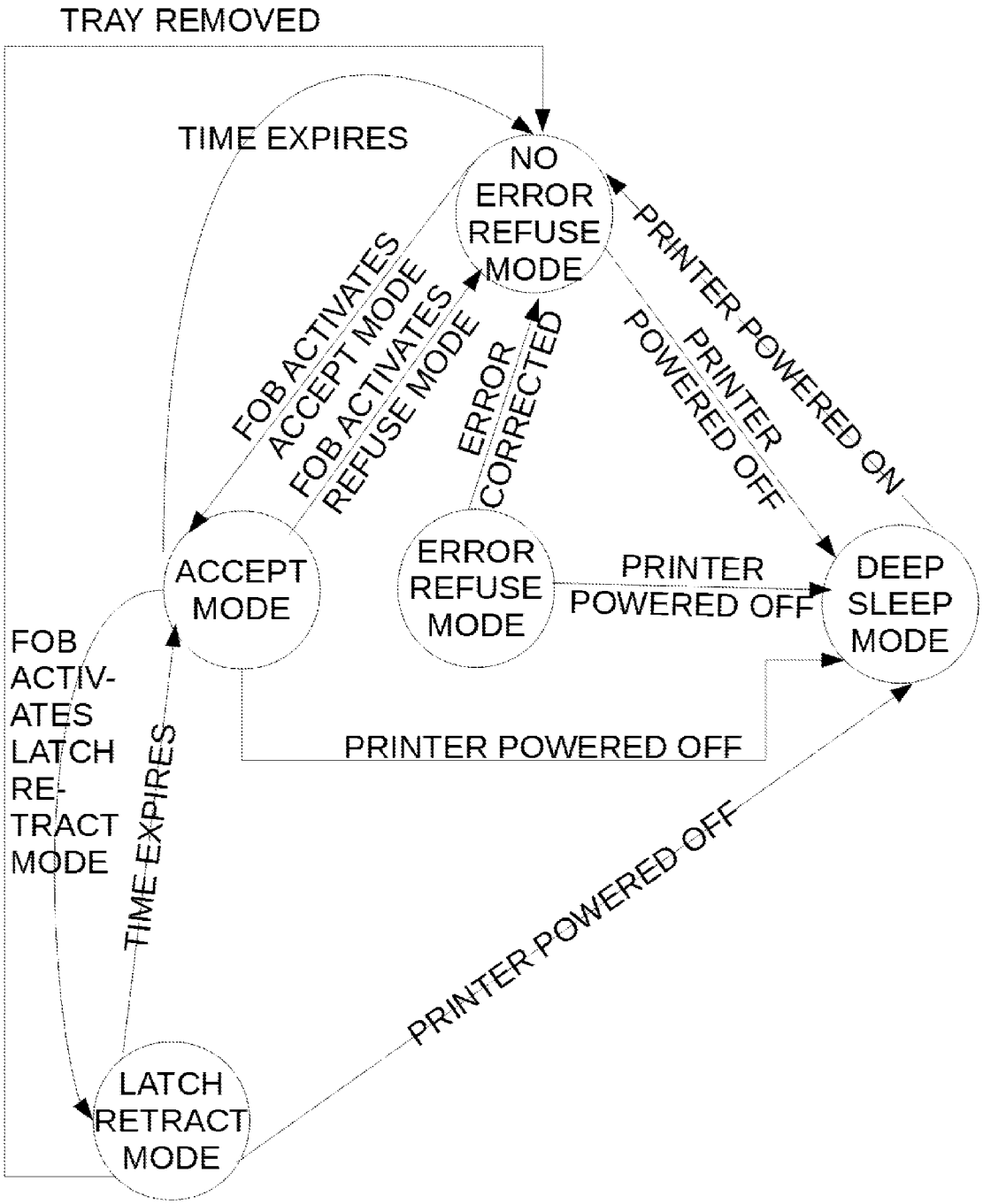
FIG. 2 is a state diagram illustrating different printer modes and mode change triggers, according to an embodiment.

FIG. 2 is a state diagram illustrating different printer modes and mode change triggers, according to an embodiment.

The secure printer (which is also referred to as "printer" herein except where "standard printer" is being referred to) can be in the deep sleep mode and when powered on would by default go into the no error refuse mode.

In the no error refuse mode, the user can put the secure printer into the deep sleep mode by powering the printer off. The user can also go into the accept mode by activating the accept mode on the fob.

In the accept mode, the user can power of the printer and go into the deep sleep mode. The user can also go back into the no error refuse mode by pressing a button on the fob. The user can also go into the latch retract mode by pressing a button on the fob.

The user can only get into the latch retract mode by pressing a button on the fob while in the accept mode. From the latch retract mode, after a predetermined amount of time expires (e.g., 30 seconds) then the printer would automatically revert back to the accept mode. In the latch retract mode, the printer can also be powered off which puts the printer into the deep sleep mode. In the latch retract mode, the user can also remove the secure tray which would put the printer into the no error refuse mode.

Figure 3:
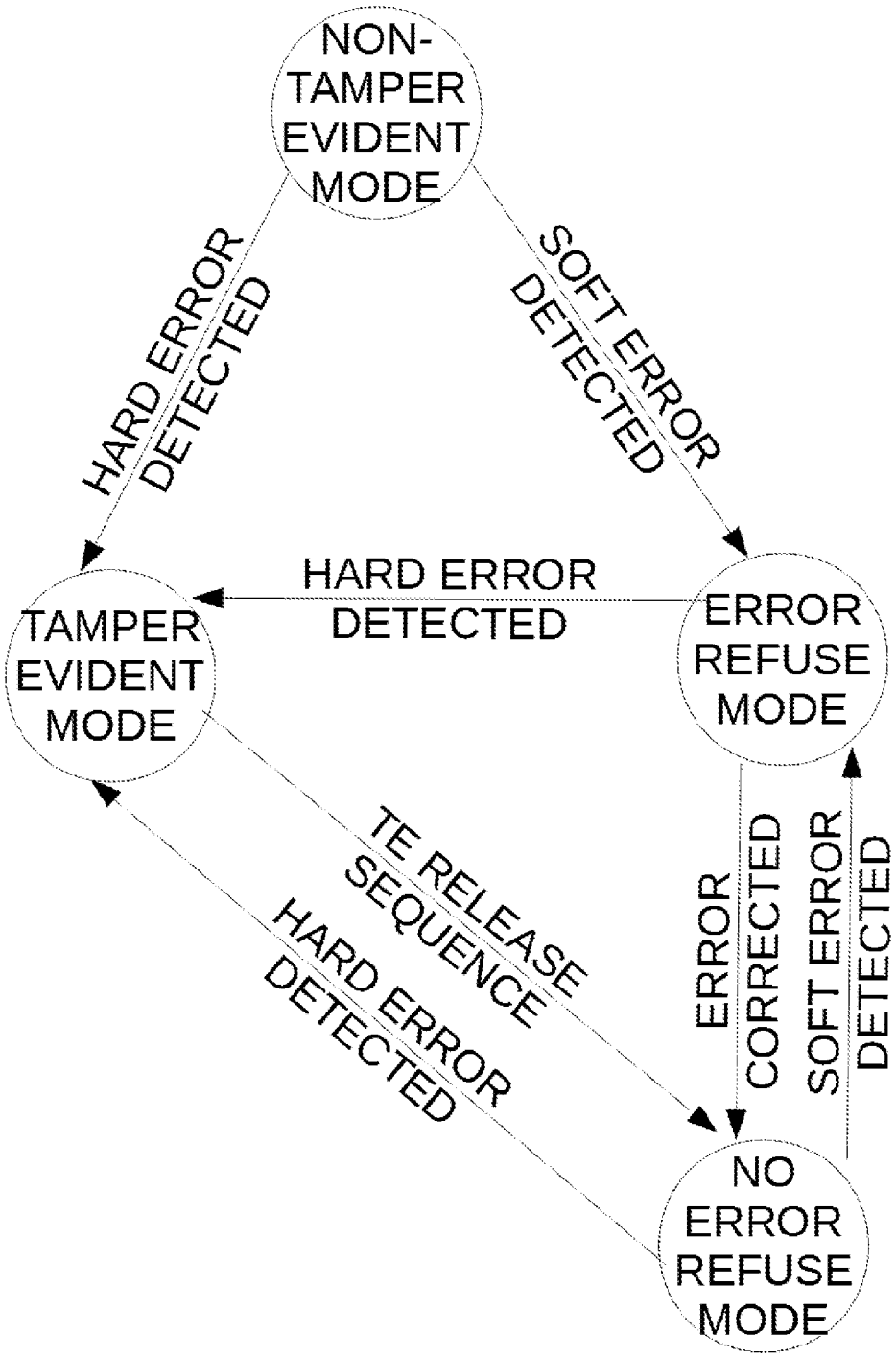
FIG. 3 is a further state diagram illustrating different printer modes and mode change triggers, according to an embodiment.

The secure printer would go into the error refuse mode when a soft error has occurred (see FIG. 3). The error refuse mode functions the same as the no-error refuse mode but the error refuse mode does not go into the accept mode. In order to go from the error refuse mode to the no-error refuse mode the error must be corrected (e.g., whatever condition caused the error would be re rectified) and (optionally) a button on the fob must be pressed. In the error refuse mode the printer can be powered down which would go into the deep sleep mode. Note, however, that when the printer is powered back up from the deep sleep mode, it would check for a soft error and on condition of a soft error it would go into the error refuse mode. Thus, if the printer is in the error refuse mode, it cannot be put into the no error refuse mode simply by turning the printer off and back on because presumably the error that caused the printer to go into the error refuse mode still exists.

FIG. 3 is a further state diagram illustrating different printer modes and mode change triggers, according to an embodiment. FIG. 3 augments the diagram shown in FIG. 2.

In the error refuse mode, if a hard error is detected the printer would go into the tamper evident mode. If the error is corrected (that caused the printer to go into the error refuse mode) then the printer would then go into the no error refuse mode.

In the no error refuse mode, the secure printer would go into the tamper evident mode upon detection of a hard error. In the no error refuse mode, the secure printer would go into the error refuse mode if a soft error is detected.

In the tamper evident mode, if a successful tamper evident release sequence is received on the fob then the secure printer would then go into the no error refuse mode.

The non-tamper evident mode comprises the accept mode and the latch retract mode. In the non-tamper evident mode, if a soft error is detected then the secure printer goes into the error refuse mode and if a hard error is detected then the printer goes into the tamper evident mode.

Figure 4:
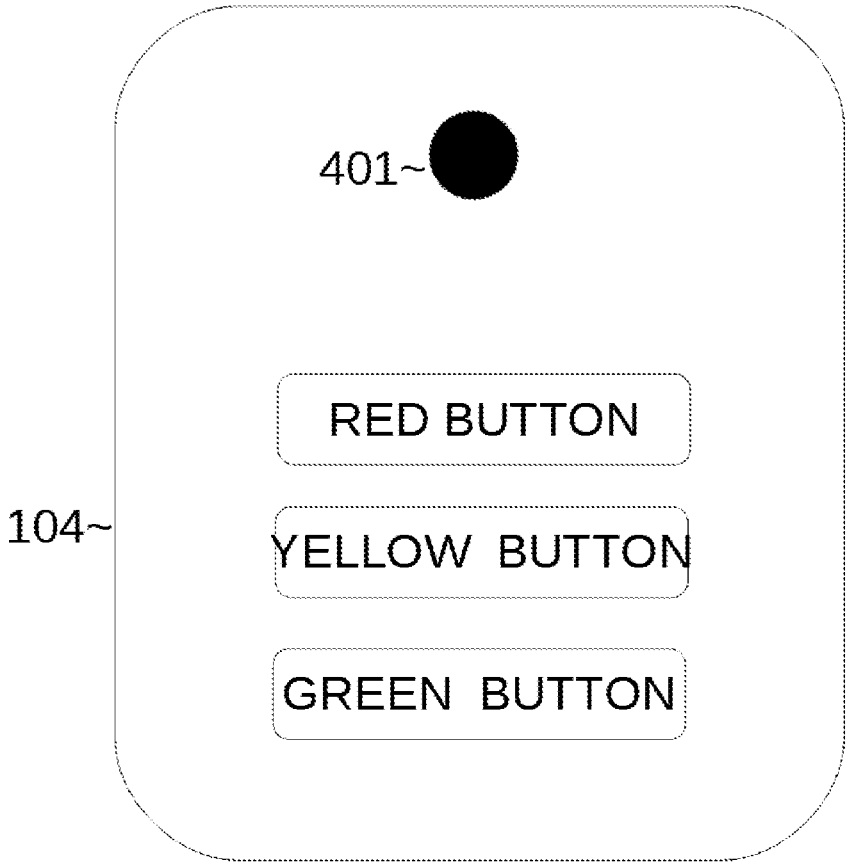
FIG. 4 is drawing of a fob used to control the printer, according to an embodiment.

FIG. 4 is drawing of a fob used to control the printer, according to an embodiment.

The fob has a multi-color LED 401 which can glow red and yellow (and any other color) to indicate the status of an operation. There can be three buttons, a red button, a yellow button, and a green button. Of course the names of the buttons are not important and any names can be given to the buttons.

The fob has different buttons which would trigger different commands on the printer (controller processor). For example, a particular button (or combination of buttons) would trigger the accept mode, another particular button (or combination of buttons) would trigger the refuse mode, another particular button (or combination of buttons) would trigger the accept mode, etc. The user is free to command the printer (using the fob) in any sequence of mode changes.

Internally, the fob has a fob processor (a processor) connected to a ROM, RAM, transceiver, power supply, buttons, LEDs, and any other structure known in the art for the proper operation of a fob.

Note that the communications between the fob and the processor 100 can use encryption (e.g., a 128 bit cipher programmable 32 bit serial number) and can incorporate code hopping, such as utilizing the off the shelf KEELOQ system that is developed by Microchip Technology Inc. (both the fob and the controller processor need to be synchronized and programmed to have the same cooperating algorithms). See for example U.S. Pat. No. 5,675,534 which describes such a secure remote transmission protocol. Utilizing a secure transmission protocol should (in theory) prevent anyone from hacking the signal somehow to be able to turn the secure printer into the accept mode (or latch release mode) without the genuine fob.

Figure 5:
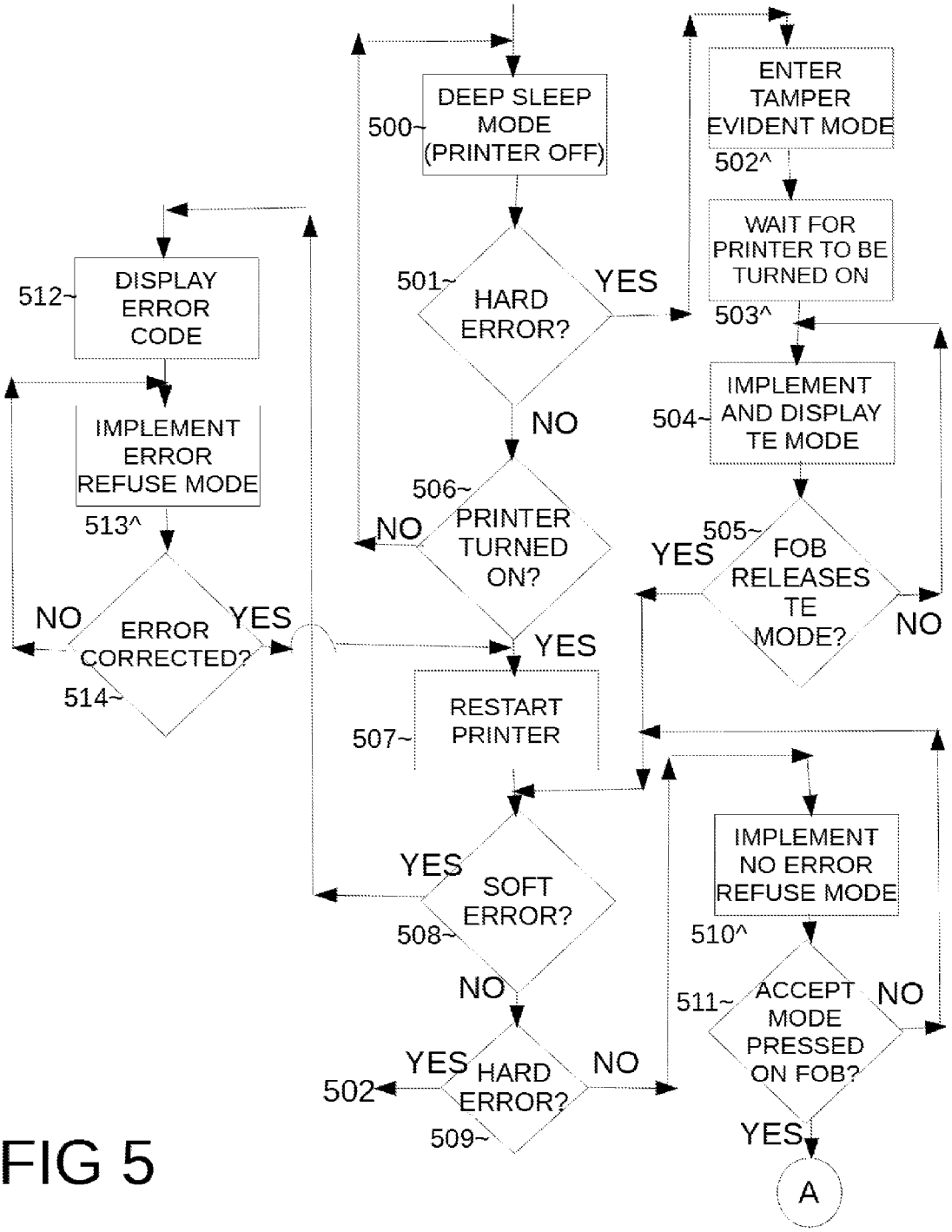
FIG. 5 is a flowchart illustrating an exemplary computer implemented method of securing a printer tray, according to an embodiment.

FIG. 5 is a flowchart illustrating an exemplary computer implemented method of securing a printer tray, according to an embodiment.

In operation 500, the printer can be in a deep sleep mode (the printer is turned off). While the printer is in the deep sleep mode, the printer is checking for hard errors.

From operation 500, the method proceeds to operation 501, which determines whether there is a hard error detected. If yes, then the method proceeds to operation 502.

If no hard error is detected in operation 501, then the method proceeds to operation 506, which determines whether the printer is turned on. If the printer is not turned on (powered on) then the method returns back to operation 500.

If in operation 501, it is determined that a hard error is detected, then the method proceeds to operation 502 which enters the tamper evident mode. In the tamper evident mode, printing to the secure tray is prohibited and also opening the latch is prohibited as well. However, the unsecure trays on the printer can still be printed to.

From operation 502, the method proceeds to operation 503 which waits until the printer is turned on.

From operation 503, when the printer is turned on, the method proceeds to operation 504 wherein the printer implements the tamper evident (TE) mode and can display an indication on the output device 110 that the printer is in the tamper evident mode (e.g., three blinking LEDs or other output).

From operation 504, the method proceeds to operation 505 which determines whether the operator has used his/her fob to release the tamper evident mode. This can be done as described herein, for example see FIGS. 7-8. If the operator has not used his/her to properly release the tamper evident mode, then the method proceeds to operation 504 which continues in the tamper evident mode.

If in operation 505 the operator has used his/her fob properly to release the tamper evident (TE) mode, then the method proceeds to operation 508.

In operation 506, if it is determined that the printer is turned on, then the method proceeds to operation 507, which restarts the printer. This includes execution some power-up routines to initialize the printer. At power up of the image forming apparatus, the printer will perform a self check to ensure that the latch assembly doesn't have any errors, that detection of any tampering did not occur and that the radio assembly (e.g., transceiver) is fully operational. If the printer was put into the tamper evident mode when it was powered down (deep sleep mode), then the method would be in operation 503. Otherwise, the power-up routines include things like connecting to the Wi-Fi, checking the printer heads, etc.

From operation 507, the method continues to operation 508 which determines if there is a soft error. If there is a soft error (see FIG. 10 on one method of determining a soft error), then the method proceeds to operation 512. A soft error can include, for example, if the secure tray is not installed into the printer when it should be. A soft error can also include, for example, that the latch is not extended when it should be. A soft error can also include, when a non-secure tray (e.g., without the detectable object) is installed in the area (latch tray assembly guides) that is designed for a secure tray (with the detectable object). A soft error can also include, for example, the non-detection of the detectable object (e.g., magnet) that is used to trigger the tray sensor (e.g., Hall Effect sensor which will detect the magnet).

In operation 512, the printer would display an error code on the output device 110 which can be series of LEDS to indicate which error has occurred.

From operation 512, the method proceeds to operation 513, which implements the error refuse mode. As described herein, the refuse mode is where the printer will allow printing from the non-secure trays not but allow printing from the secure trays nor will it allow the secure tray to be removed. The "error refuse mode" means that there is an error that must be corrected before it can go into the "non error" refuse mode.

From operation 513, the method proceeds to operation 514 which determines whether the error is corrected. For example, if the secure tray was not present in the printer which triggered the error refuse mode, then the secure tray must be put back into the printer in order to correct the error. In order to correct the error, a particular button must also be pressed on the fob. If the error is not corrected (that caused the error refuse mode), then the method returns to operation 513 which continues operation of the printer in the error refuse mode. If the error is corrected, then from operation 514, the method proceeds to operation 507.

In operation 508, if there is no soft error, then the method proceeds to operation 509, which determines whether there is a hard error. A hard error, as described herein, is when one of the connectors (cables) has been disconnected which means the printer has been tampered with. If there is a hard error, then the method returns to operation 502. If there is no hard error, then the method proceeds from operation 509 to operation 510.

In operation 510, the printer implements the no error refuse mode (wherein the printer can operate and print to the non-secure trays but will not print to the secure tray nor will allow the secure tray to be removed). The no error refuse mode is similar to the error refuse mode but there is no error to correct meaning the mode can be changed from the no error refuse mode to the accept mode.

From operation 510, the method proceeds to operation 511 which determines whether the accept mode button is pressed on the fob (or in an embodiment it can be a combination of buttons). If the proper button(s) are not pressed on the fob to go into the accept mode then the method returns to operation 508 which continues operation of the printer in the no error refuse mode while checking for errors.

Figure 6:
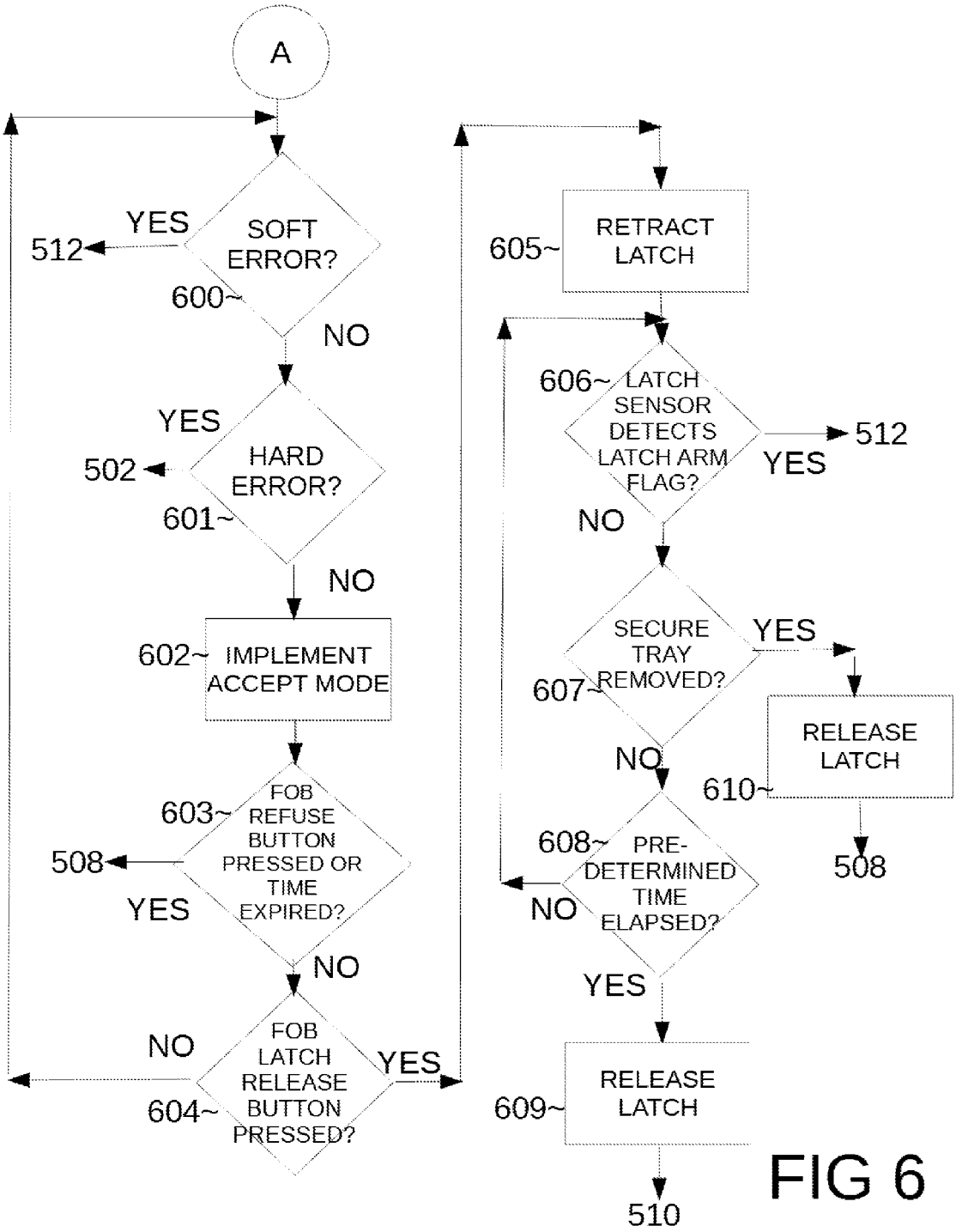
FIG. 6 is a flowchart illustrating a continued exemplary computer implemented method of securing the printer tray, according to an embodiment.

If in operation 511, the proper button(s) are pressed on the fob to initiate the accept mode, then the method proceeds to operation 600 (see FIG. 6).

FIG. 6 is a flowchart illustrating a continued exemplary computer implemented method of securing the printer tray, according to an embodiment.

In operation 600, the printer determines whether there is a soft error (this can be done as described herein). If there is a soft error, then the method returns to operation 512. If there is no soft error in operation 600, then the method proceeds to operation 601.

In operation 601, it is determined whether there is a hard error. This can be done as described herein. If there is a hard error, then the method returns to operation 502. If there is no hard error, then the method proceeds to operation 602. A hard error is an error that places that printer in refuse mode and requires the successful completion of a decrypting process to release this error. All three LEDs of the printer will flash in sequence when a hard error is active.

In operation 602, the printer implements the accept mode. The accept mode allows the printer to print from both the non-secure trays as well as the secure tray. From operation 602, the method proceeds to operation 603.

In operation 603, the printer determines whether the fob refuse button (the button or buttons that return the printer to the refuse mode from the accept mode) is pressed. If yes, then the method proceeds to operation 508. In operation 603, it is also determined whether the time in the accept mode has expired. When the printer first enters the accept mode in operation 602 the time is stored (the "accept mode entry time"). The difference between the current time and the accept mode entry time is computed, and if it is greater than a predetermined threshold (e.g., four hours), then the method returns to operation 508 wherein the mode would automatically return back to the no error refuse mode (assuming there are no errors). This limits the time the printer is in the accept mode to four hours (or other predetermined amount of time). If the predetermined amount of time has been exceeded, then the operator can simply put the printer back into the accept mode (from the refuse mode) in operation 511 by pressing the respective keys on the fob.

If in operation 603, the printer determines that the fob refuse button is not pressed, and that the time in the accept mode has not expired, then the method proceeds to operation 604, which determines whether the fob latch release button (the button or buttons that initiate the latch release mode) is pressed. If not, then the method returns to operation 600.

If in operation 604, the latch release button is pressed, then the method proceeds to operation 605 which retracts the latch. This can be done by energizing the latch solenoid 109, which retracts the latch arm which in turn retracts the latch. When the latch is retracted, the secure tray can simply be removed from the secure printer by sliding out the secure tray as now there is nothing preventing the secure tray from being removed (unlike when the latch is extended into a notch in the side of the secure tray which prevents the secure tray from being removed).

From operation 605, the method proceeds to operation 606, wherein it is determined whether the latch sensor 112 confirms the retracted latch. The latch sensor uses a light beam to shine to a sensor (a photo interrupter). If the latch arm flag is present (not retracted and hence in the default position) then the light beam should be blocked and if the latch arm flag is not present through the beam then this signifies that the latch is retracted. In theory, when the latch is retracted in operation 605, the latch sensor should detect the beam of light because the latch arm flag would move out of the path of the light beam which hits the photo interrupter. If the latch is extended (in the default position when the latch solenoid is not energized), the latch sensor should not detect the beam of light because the latch arm flag would be blocking the path of the light to the photo interrupter. If in operation 606, if the latch sensor detects the latch arm flag then something is wrong (e.g., the latch is not retracted which means perhaps the latch mechanism and/or latch sensor was tampered with) and this generated a soft error and the method proceeds to operation 512.

If in operation 606, the latch sensor does not detect the latch arm flag (which means the latch properly retracted), then the method proceeds to operation 607, which determines whether the tray (the secure tray) is removed. This determination can be made by checking the tray sensor 102. The tray sensor can detect a magnet or an RFID marker on the side of the tray. If the tray sensor detects that the secure tray (also referred to as cassette) as been removed, then the method proceeds to operation 508 which releases the latch (de-energizes the latch solenoid 109). The method then proceeds to operation 508 which checks for errors and then goes into the no error refuse mode.

If in operation 607, it is detected that the secure tray is not removed, then the method proceeds to operation 608, which determines whether the latch retract mode time is greater than a predetermined threshold (e.g., 30 seconds). When the latch retract mode is first entered (in operation 605) the time is stored (the "latch retract mode entry time"). The difference between this time and the current time is computed which results in the amount of time the printer has been in the latch retract mode (having the latches retracted enabling removal of the secure tray). If the amount of time the printer has been in the latch retract mode is smaller than the predetermined amount of time (the predetermined amount of time has not elapsed) then the method returns to operation 606.

If in operation 608, it is determined that the amount of time the printer has been in the latch retract mode is at least equal to the predetermined time (e.g., 30 seconds) then the method proceeds to operation 609 which releases the latch (de-energizes the latch solenoid) and proceeds to operation 510. With the latch extended in its default position, the secure tray inside the printer cannot now be removed. Of course, the latch retract mode can be activated again by pressing the latch release button(s) on the fob (in operation 604) and the printer will reset the latch retract mode entry time to the new time the latch retract mode has been entered again.

Figure 7:
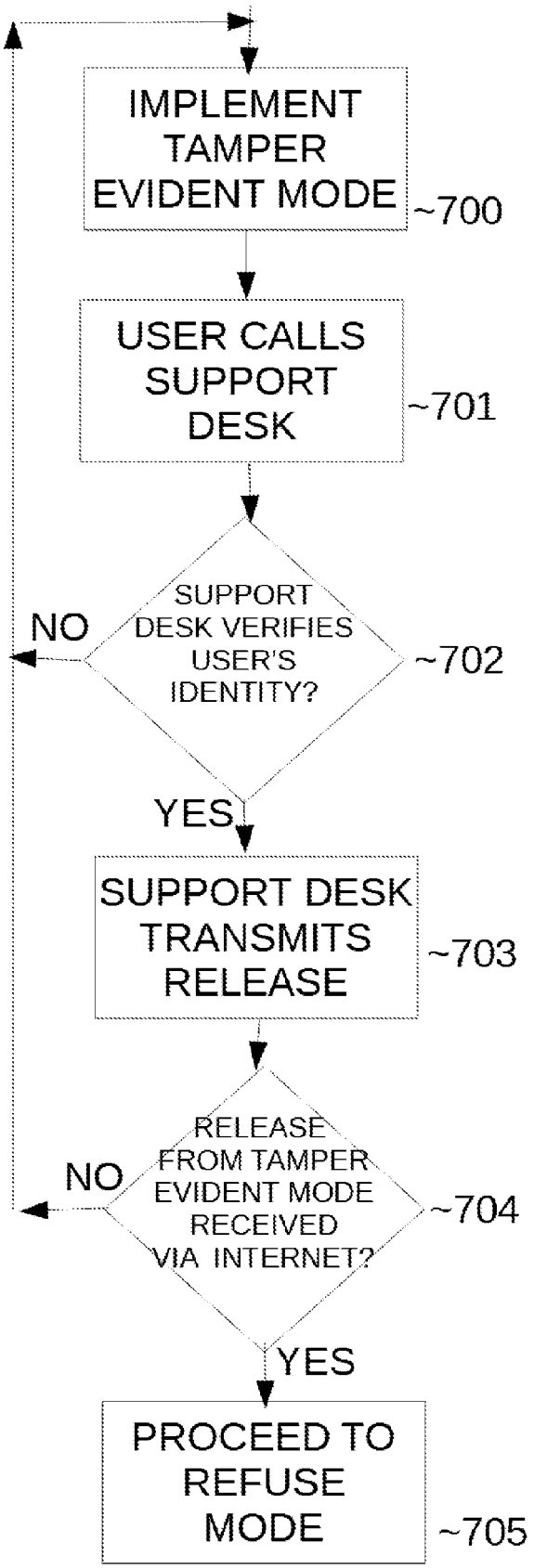
FIG. 7 is a flowchart illustrating an exemplary method of changing the mode from the tamper evident mode to the refuse mode via a remote network request, according to an embodiment.

FIG. 7 is a flowchart illustrating an exemplary method of changing the mode from the tamper evident mode to the refuse mode via a remote network request, according to an embodiment. In an embodiment, the operator (also referred to as user) is not able to get the printer out of the tamper evident mode but instead it must be done by contacting a support desk at a remote location so they can verify the user's identity. The support desk can then change the printer out of the tamper evident mode (into the refuse mode) by sending a remote signal. If the printer is in the tamper evident mode, this may signify that someone tried to tamper with the printer, which is very serious, so that an extra layer of security is beneficial before the printer is removed from the tamper evident mode.

In operation 700, the printer implements the tamper evident mode. As described herein, the tamper evident mode does not allow the operator to print to or open the secure tray.

From operation 700, the method proceeds to operation 701, wherein the user calls a support desk at a remote location. The support desk would typically be a party that services the secure printer. The user can provide the support desk his/her name and serial number of the printer so that the support desk can verify the user's identification.

From operation 701, the method proceeds to operation 702, which determines whether the support desk verifies the user's identity. If the user's identity cannot be verified, then the method returns to operation 700 and the printer remains in the tamper evident mode.

If in operation 702, the support desk verifies the user's identity, then the method proceeds to operation 703, wherein the support desk transmits a release code to the printer via the internet. The release code can be an encrypted code which can be directed to the printer (e.g., via its IP address) and received by the printer via its network connection 105.

From operation 703, the method proceeds to operation 704, which determines whether the code has been received by the printer from the support desk (or other party/source associated with the support desk). If the release code has not been received, then the method returns to operation 700.

If in operation 704, the release code has been received, then the method proceeds to operation 705, wherein the printer mode is now changed from the tamper evident mode to the refuse mode.

Another method of changing the printer mode out of the tamper evident mode into the refuse mode is by the operator (also referred to as user) calling the support desk but the user implements a sequence of keypresses on the fob in order to change out of the tamper evident mode.

Figure 8:
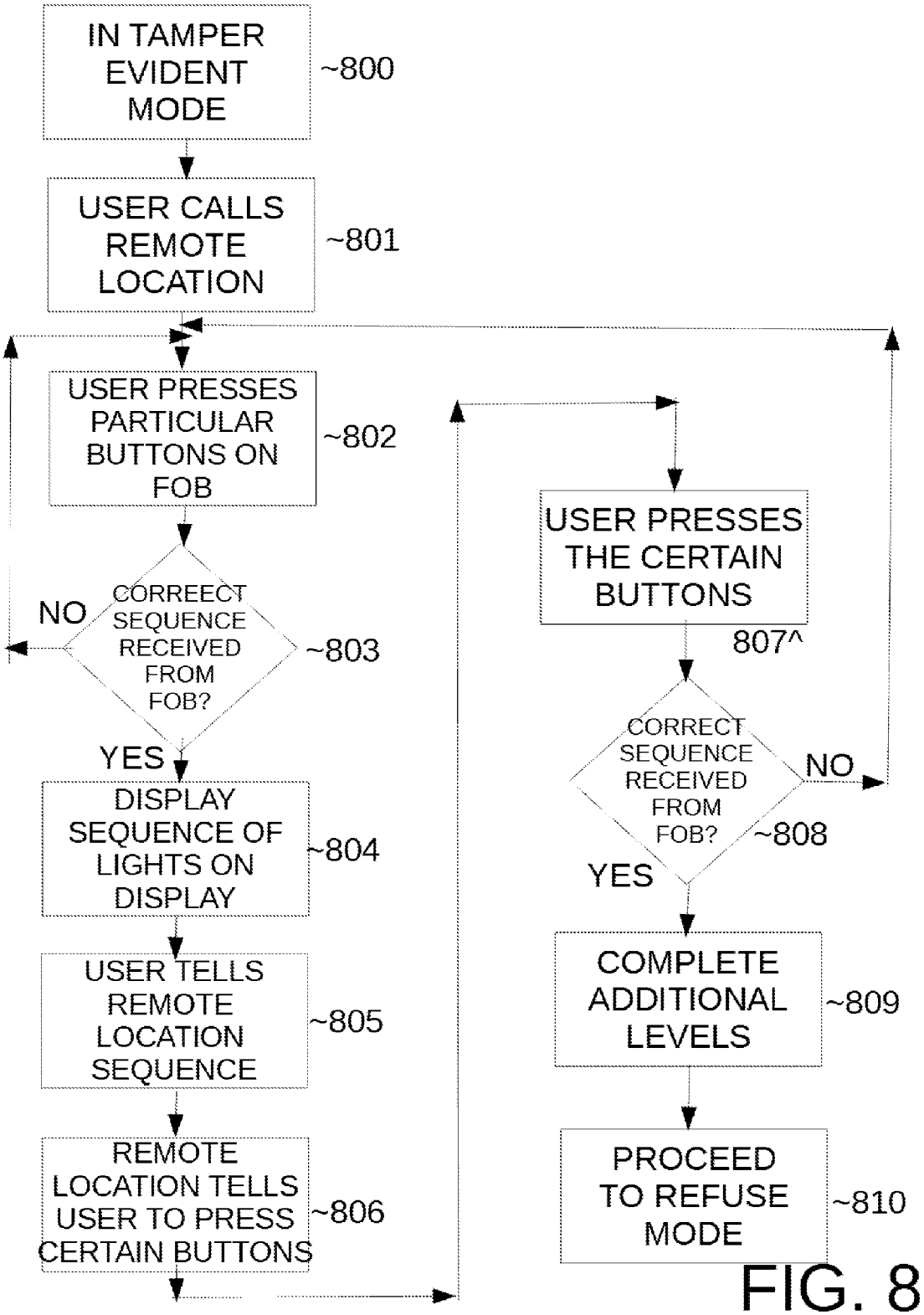
FIG. 8 is a flowchart illustrating an exemplary method of verifying the correct sequence from the fob, according to an embodiment.

FIG. 8 is a flowchart illustrating an exemplary method of verifying the correct sequence from the fob, according to an embodiment.

In operation 801, the user calls the remote location (the support desk). This can be done as in operation 701. The operator at the support desk can tell the user the particular buttons on the fob to press to initiate the tamper evident mode release sequence.

From operation 801, the method proceeds to operation 802, wherein the user presses a particular button or buttons on the fob to initiate a tamper evident mode release sequence. The tamper evident mode release sequence is a sequence of button presses on the fob which confirm that the user has spoken to the support desk and will change the mode (when successfully executed) from the tamper evident mode to the refuse mode.

From operation 802, the method proceeds to operation 803, which determines whether the user pressed the proper keys on the fob in order to initiate the tamper evident mode release sequence. If the user did not press the proper keys on the fob, then the method returns to operation 802 (operation 800) wherein the printer remains in the tamper evident mode.

If in operation 803, the user has correctly pressed the buttons on the fob to initiate the tamper evident release sequence, then the method proceeds to operation 804.

In operation 804, the output device 110 (the LEDs) will display a random pattern of lights (some may be solid some may be blinking). The random patter can be generated by the processor 100 itself.

From operation 804, the method proceeds to operation 805, wherein the user tells the operator at the remote location (via the telephone) the sequence of lights that he/she sees.

From operation 805, the method proceeds to operation 806 wherein the operator at the remote location tells the user which buttons on the fob to press. The operator will have a look up table (or computer program) which when looking up (or typing in) an LED sequence, it will output certain keys to press. This is in a sense a type of code to verify that the user really got into contact with the support desk. Thus, the keys the operator tells the user to press are determined using this lookup process.

From operation 806, the method proceeds to operation 807, wherein the user presses the buttons that the operator told him in operation 806. All button presses on the fob are transmitted to the printer for processing.

From operation 807, the method proceeds to operation 808, wherein the processor 100 determines whether the correct button sequence was pressed by the user in operation 807. Note that the printer would know the proper button sequence to be pressed for each LED pattern ("mapping") which can be prestored by the printer. The remote location would store the same mapping. If the incorrect buttons are pressed on the fob, then the method returns to operation 802 which can begin the process all over again.

If in operation 808, the user pressed the correct button sequence, then the method proceeds to operation 809 wherein the user can be required to complete additional levels. A level can be defined as operations 804 to 808. For example, there can be three such levels which are required before the method will proceed to operation 810 which will change the secure printer to the refuse mode (from the tamper evident mode). If any presses are incorrect during the levels, then the method would return to operation 802 where the user can start all over again.

Note that the mapping can change for different levels. For example, in the first level, if the output device 110 displays a simultaneous continuous red LED along with a blinking green LED, then the required button presses on the fob might be pressing the red button. But in the second level, the same display of a continuous red LED along with a blinking green LED might have a required button presses of pressing the yellow button and green button simultaneously. Using different mappings for each level would make the "code" harder to crack by a user.

Figure 9:
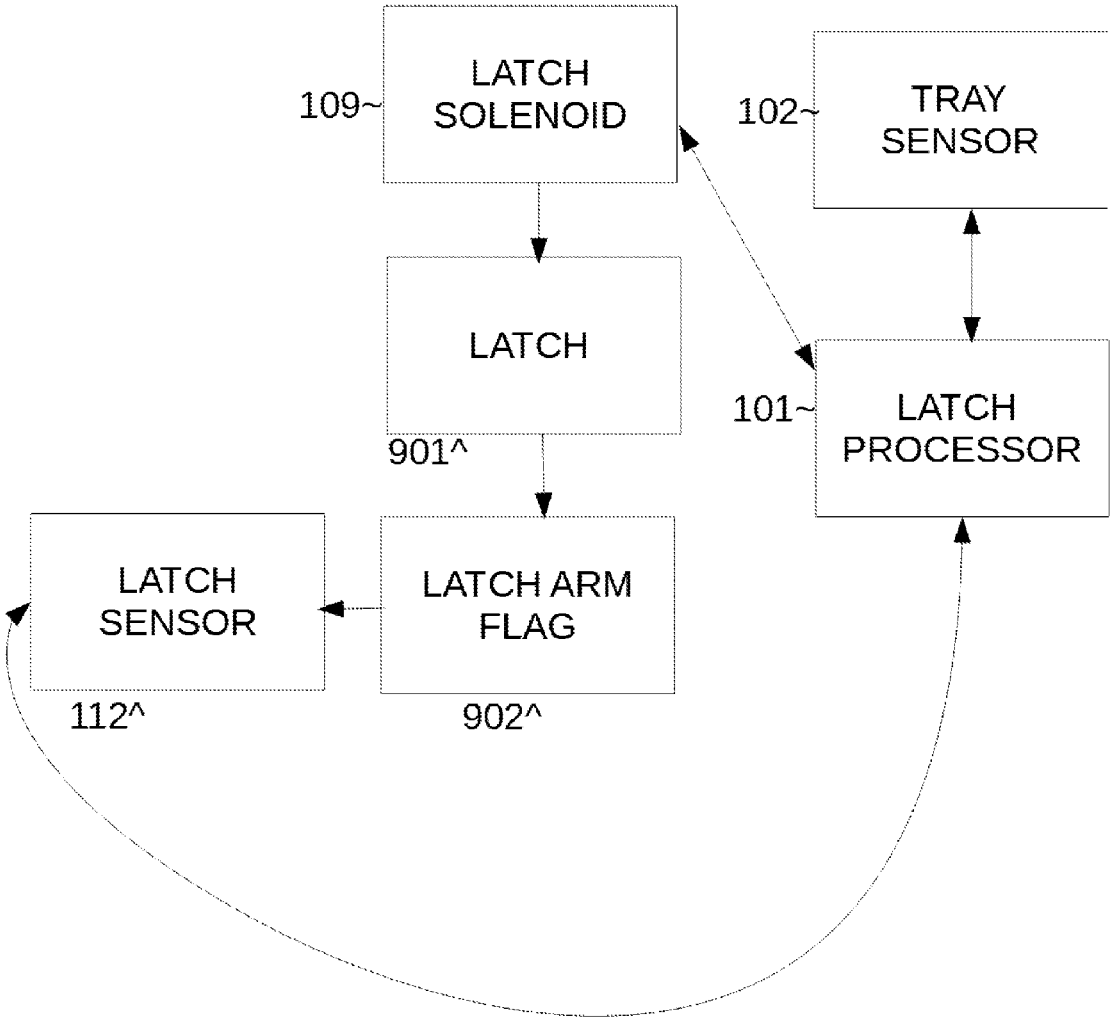
FIG. 9 is a block diagram illustrating the physical components of a latch assembly, according to an embodiment.

FIG. 9 is a block diagram illustrating the physical components of a latch assembly, according to an embodiment.

The latch processor 101 is a microprocessor and any associated structure (e.g., bus, cache, power supply, etc.) the latch processor 101 is in communication with the tray sensor 102 which detects whether the secure tray is present (by detecting a detectable object on a side of the secure tray) and detects whether the secure tray is absent (by the absence of the detectable object being present).

The latch processor 101 is also connected to the latch solenoid 109. The processor 100 can instruct the latch processor 101 to energize the latch solenoid 109 to open (retract) the latch at the appropriate time (e.g., when the latch release mode is initiated). The latch processor 101 requires a secure code in order to energize the latch solenoid 109 so that it would be difficult or impossible for a hacker to hack into the printer and instruct the latch processor 101 to energize without knowing the secure code. The processor 100 can also instruct the latch processor 101 to de-energize the latch solenoid 109 to close (extend) the latch.

The latch solenoid 109 is connected to a latch 901. The latch 901 moves when the latch solenoid 109 is energized (to the retracted position (unlocked)) and naturally reverts back to its default position when no longer energized (to the extended position (locked)). A latch arm flag 902 is connected to the latch 901. The latch sensor 112 detects the presence and absence of the latch arm flag 902. The latch sensor 112 can be a photo interrupter to detect the presence/absence of the latch arm flag 902. If the latch arm flag 902 is detected by the photo interrupter (the light beam is blocked), then it is determined that the latch arm flag 902 is present and is in the latch 901 is in the extended (locked) position meaning the latch solenoid is not energized and thus prohibiting removal of the secure tray. If the latch arm flag is detected as being absent (the light beam is not blocked) then the latch arm flag has moved meaning the latch solenoid is in the energized position and hence the latch itself is in the retracted position (unlocked) thus enabling removal of the secure tray (see FIGS. 24-27).

The latch processor 101 is the "liaison" between the latch solenoid 109, latch sensor 112, tray sensor 102, and the processor 100. Hence the processor 100 would typically have to communicate with the latch processor 101 in order to communicate/instruct the latch solenoid 109, latch sensor 112, and tray sensor 102.

Figure 10:
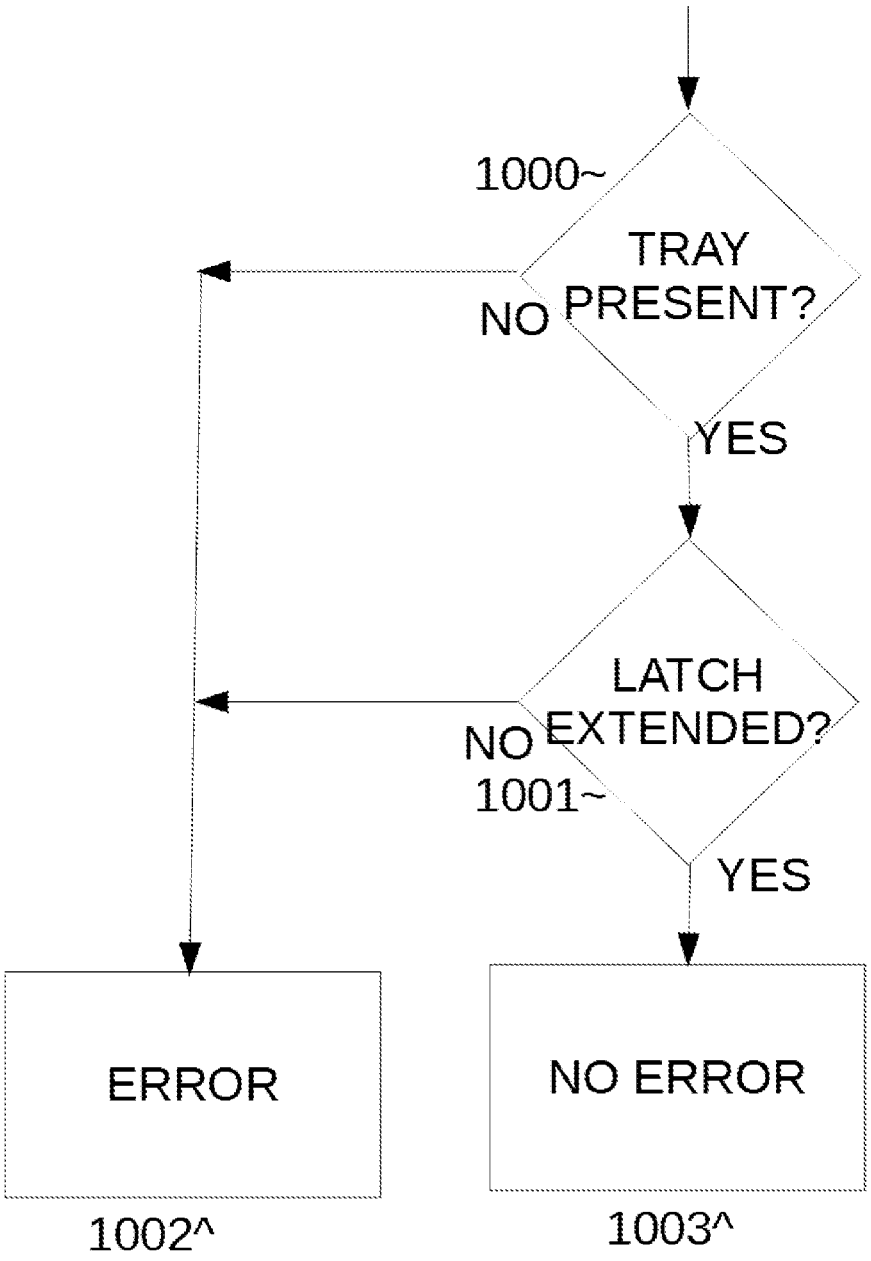
FIG. 10 is a block diagram illustrating an exemplary method of checking for errors, according to an embodiment.

FIG. 10 is a block diagram illustrating an exemplary method of checking for errors, according to an embodiment. FIG. 10 can be considered checking for "soft" errors.

In operation 1000, the printer determines whether the secure tray is present. This can be done by querying the tray sensor 102. If the secure tray is not present when it should be, then the method proceeds to operation 1002 which generates a soft error. The secure tray should be present at all times, except after it was removed during the latch retract mode. If the tray sensor 102 does not detect the detectable object then it is determined that the secure tray is not present. If the tray sensor 102 does detect the detectable object, then it is determined that the secure tray is present.

If the secure tray is present in operation 1000, then the method proceeds to operation 1001 which determines whether the latch is extended (the default position). This can be determined by querying the latch sensor 112. If the latch is not extended when it should be, then the method proceeds to operation 1002. The latch should always be extended except in the latch retract mode. If the latch is extended, then the method proceeds to operation 1003. If the latch sensor 112 detects light, then it is determined that the latch is retracted (see FIGS. 26-27), and if the latch sensor 112 does not detect light then it is determined that the latch is extended (see FIGS. 24-25).

In operation 1003, no soft error is generated.

In operation 1002, a soft error is generated, which means that in RAM it can be stored that currently there is a soft error generated and the type of soft error can also be stored (e.g., secure tray not present or latch not extended). The program running on the processor 100 to implement the methods described herein can now branch to a different block of code based on the soft error being generated.

When the fob wirelessly transmits commands to the secure printer, the printer would communicate back with the fob that the command was performed or that the command was not performed. If the printer does not respond to a command sent by the fob, then the printer may be out of range and the fob can indicate this type of error to the user.

Figure 11:
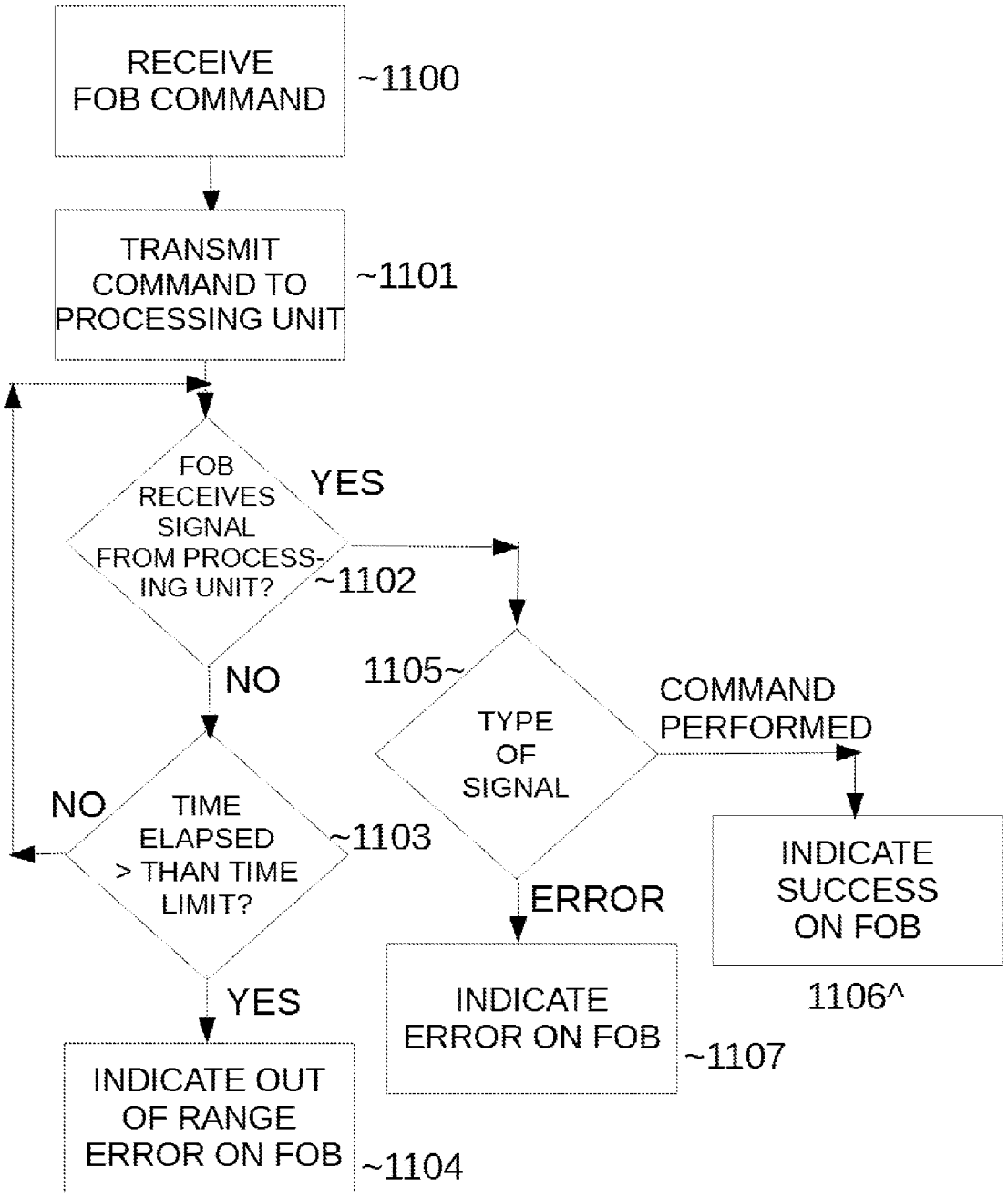
FIG. 11 is a block diagram illustrating an exemplary method of issuing a command to the printer from the fob, according to an embodiment.

FIG. 11 is a block diagram illustrating an exemplary method of issuing a command to the printer from the fob, according to an embodiment.

In operation 1100, the user (operator) presses a button (or combination of buttons) on the fob.

From operation 1100, the method proceeds to operation 1101, wherein the button(s) pressed on the fob are transmitted to the processor 100 (via the transceiver 103).

While not pictured, if the secure printer (e.g., the processor 100) receives the signal transmitted by the fob in operation 1101, then it will send an acknowledgement back to the fob indicating the command issued on the fob has been performed or has not been performed (due to some error or some other reason).

From operation 1101, the method proceeds to operation 1102, which determines whether the fob receives a signal back (response) from the processor 100 (in response to the transmission in operation 1101). If no response is received, then the method proceeds to operation 1103.

In operation 1103, it is determined if the time elapsed since the transmission in operation 1101 exceeds a predetermined amount of time (e.g., 2 seconds). If the time has not exceeded the predetermined amount of time, then the method returns to operation 1102 which keeps listening for a response from the printer.

If in operation 1103 it is determined that the elapsed period of time since the user first issued the command (in operation 1101), then the method proceeds to operation 1104 wherein the fob will light up a light(s) indicating a no response error (e.g., a solid red light). This can be caused by the printer being out of range, the printer being powered off, or the printer malfunctioning.

If in operation 1102, the fob receives a signal from the processor 100 (e.g., printer) in response to the transmission in operation 1101, then the method proceeds to operation 1105 which determines what type of signal (code) was received. There can be two types (categories) of signals received, errors and successes. If an error code is received by the fob from the printer, then the method proceeds to operation 1107 and the fob would display an output (e.g., a blinking red light) indicating that an error occurred on the secure printer and the command issued in operation 1101 was not performed by the printer.

If in operation 1105, the signal received back from the secure printer is a success code (the command in operation 1101 performed) then the method proceeds to operation 1106 which indicates that the command transmitted in operation 1101 to the secure printer was successfully performed (e.g., displaying a solid green light).

In the conversion embodiment, a standard printer can be converted into a secure printer. This can be done by fitting the standard printer with additional components required to implement the functions described herein. One of the steps in the conversion would be to "hijack" the paper out detector on a standard printer so that the paper out signal can be controlled by the processor 100 so that the processor 100 can prevent printing to the secure tray.

Figure 12:
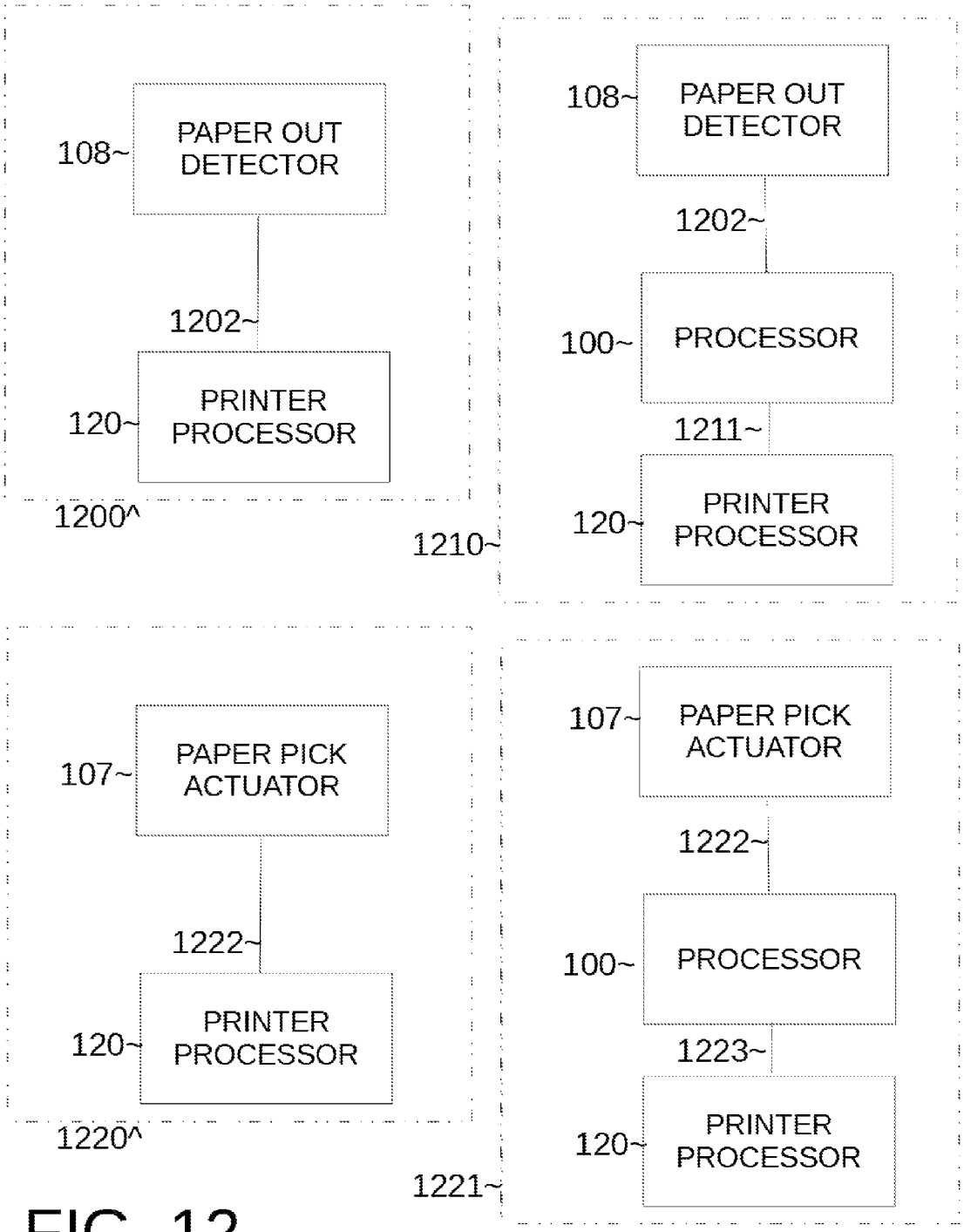
FIG. 12 illustrates the how the paper out detector of a standard printer is converted into a secure printer, according to an embodiment.

FIG. 12 illustrates how the paper out detector of a standard printer is converted into a secure printer, according to an embodiment. FIG. 12 would only apply to the conversion embodiment. In order for the converted printer to be able to prevent printing to the secure tray, the pickup roller for the secure tray can be disabled by emulating a "paper out" error. The paper out detector is in a standard printer and can use a photo interrupter to detect the presence (and hence its absence) of paper in the secure paper tray. If there is a paper out error, then the printer processor 120 would not print to the secure paper tray if the paper is out in the secure paper tray. So by emulating a "paper out" error, this can effectively disable the pickup roller for the secure paper tray in what was previously a standard printer which is now converted into a secure printer.

A standard paper out circuit 1200 on a standard printer comprises a paper out detector 108 (e.g., a photo-interrupter where paper breaks the light signal) connected by a paper out cable 1202 to the printer processor 120 (which executes a program which prevents printing to a tray which has no paper according to the paper out detector 108).

The standard paper out circuit 1200 is physically modified by an installer who is converting a standard printer to a secure printer. The paper out cable 1202 is connected between the paper out detector 108 and the processor 100, and an additional cable 1211 connects the processor 100 to the printer processor 120. In this manner, the processor 100 can now send a "paper out" or a "paper present" signal for the secure tray to the printer processor 120 so that printing to the secure tray can be prevented when the printer processor 120 is programmed to prevent such printing (e.g., in all modes but for the accept mode). The paper out detector 108 is still operational so that the processor 100 can receive its signal and still perform the functions that would be performed based on the paper out or paper present signal. For example, if the secure printer is in the accept mode but the paper out detector (in the secure tray) detects that there is no paper in the secure tray then the processor 100 would still prevent printing to the secure tray because there is no paper therein. However, if the secure printer is in the accept mode and there is paper in the secure tray then the secure printer would enable printing to the secure tray. Note that each tray in the printer would have its own paper out detector, and paper out detector 108 refers to the one in the secure tray. If the paper out detector 108 detects that there is no paper in the secure tray, then the processor 100 would not allow printing to the secure tray regardless of what mode the secure printer is currently in.

In one embodiment, as described herein, is the manufactured secure tray printer. This is different than the conversion embodiment in that the manufactured secure tray printer is originally manufactured to be a secure tray printer. This is in contrast to the conversion embodiment in which a standard printer (without a secure tray) is converted to a secure printer with a secure tray. There is a manual, physical installation process to convert a standard printer without a secure tray to a secure tray printer with a secure tray. The installer will of course need the parts and then any standard printer can be fitted with the parts to convert it to a secure printer.

FIG. 12 also shows how the paper pick actuator 107 of a standard printer is converted into a secure printer, by rerouting it similarly to how the paper out signal is rerouted. The paper pick actuator circuit for a standard printer 1220 has the paper pick actuator 107 connected to the printer processor 120 via a paper pick actuator cable 1222. In the paper pick actuator circuit for the conversion embodiment 1221, the paper pick actuator cable 1222 is disconnected from its connection to the printer processor 120 and reconnected to the processor 100, and the processor 100 then has a connection to the printer processor 120 via a supplemental cable 1223 to the printer processor 120 (alternatively the additional cable 1211 may be used instead of the supplemental cable 1223).

Thus, the printer processor 120 no longer has a direct connection to the paper pick actuator 107 and hence now does not have direct control over the paper pick actuator 107 and must go through the processor 100 first before the printer processor 120 issues any commands to the paper pick actuator 107. In this way, the processor 100 can have complete control over the paper pick actuator 107 and make sure that the paper pick actuator 107 only enables (activates) the pickup roller for the secure tray only when printing is permitted to the secure tray.

Figure 13:
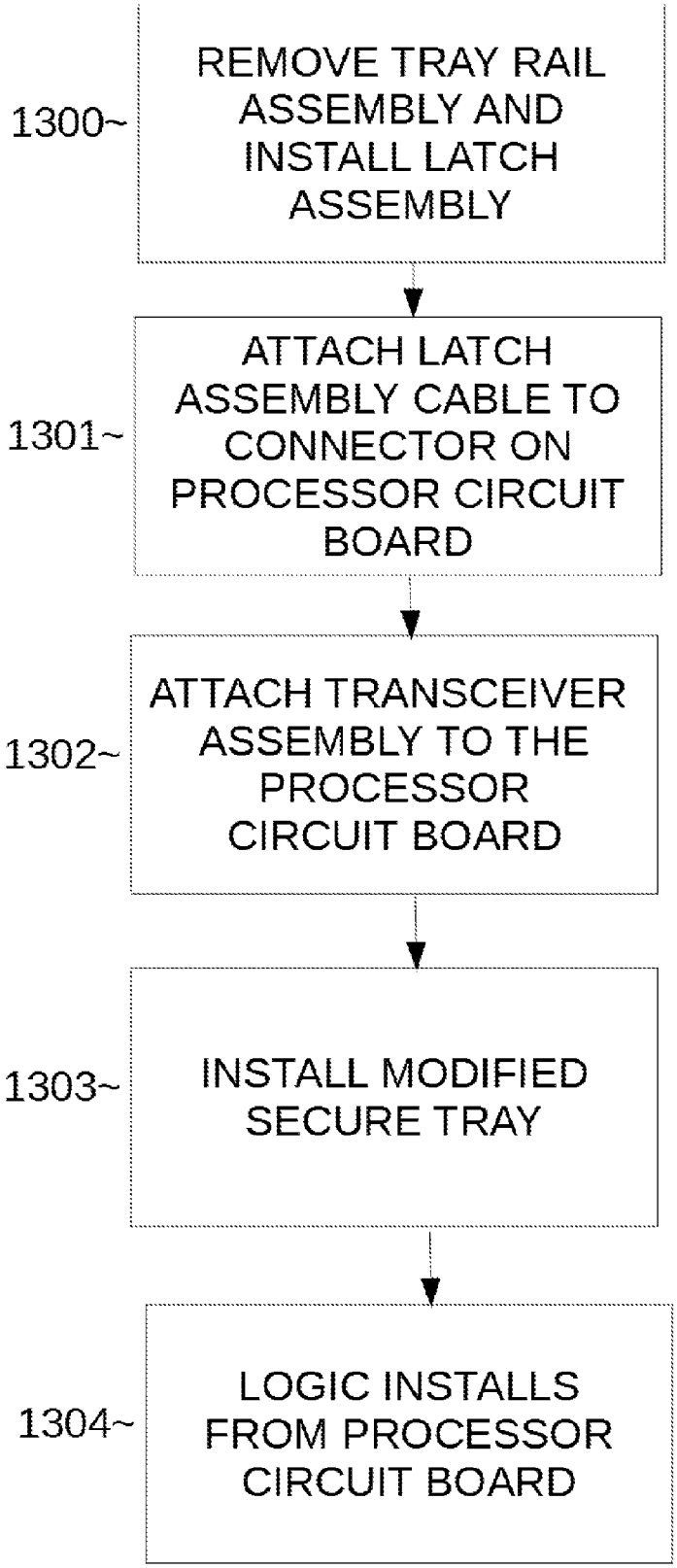
FIG. 13 is an exemplary flowchart illustrating a method of converting a standard printer to a secure printer, according to an embodiment.

FIG. 13 is an exemplary flowchart illustrating a method of converting a standard printer to a secure printer, according to an embodiment.

The installation can begin with operation 1300, wherein the installer removes the tray rail guide assembly and installs the latch assembly. The tray rail guide assembly is illustrated in FIG. 21 and can be removed with a screwdriver or other standard tools. The latch assembly (as described herein) can comprise the latch solenoid, the latch arm (attached to the latch), the latch arm flag (attached to the latch arm), the latch sensor, the tray sensor, a guide (which the tray slides through), and the latch controller printed circuit board (which contains the latch processor 101 and any associated circuitry which controls the latch solenoid and receives signals from the latch sensor and the tray sensor, and any other functions associated with the latch assembly), any other structures located on the latch assembly (see FIGS. 17A-27), and any other structures associated with the latch assembly. Typically, a standard printer may come with four tray rail guide assemblies and only one would be removed and replaced with the latch assembly, although in another embodiment more than one tray rail guide assemblies can be replaced with latch assemblies as described herein.

From operation 1300, the method proceeds to operation 1301, wherein the installer attaches a latch assembly cable connecting the processor 100 (on a processor circuit board which houses the processor 100) to the latch processor 101. The cable connecting the paper out detector 108 to the printer processor 120 is disconnected and the paper out detector 108 is connected via cable to the processor 100. Another cable is used to connect the processor 100 to the printer processor 120. See FIG. 12. The cable connecting the paper pick actuator 107 to the printer processor 120 is disconnected and instead a cable is installed connecting the paper pick actuator 107 to the processor 100 (see FIG. 12).

From operation 1301, the method proceeds to operation 1302, which attaches a transceiver assembly to the processor 100 (or actually it attaches to a connector on the processor circuit board which houses the processor 100). The transceiver is what communicates with the fob.

From operation 1302, the method proceeds to operation 1303, wherein the installer installs the modified secure tray. The modified secure tray (the secure tray) is the previous tray but with the detectable object (e.g., RFID marker, magnet) installed (attached) to a side of the secure tray which will coincide with the tray sensor 102 on the latch assembly when the secure tray is fully pushed into the guide in the latch assembly (the secure tray's respective secure shelf in the secure printer).

From operation 1303, the method proceeds to operation 1304, wherein the logic (programming) to implement the system is installed (programmed) into a memory on the printed circuit board housing the processor 100. The fob can then be paired (as known in the art) with the transceiver 103. All of modes, functionality, features, etc., described herein that the secure printer can perform can be coded onto the memory which can be read by the processor 100 so that the processor 100 can implement all of these features. Of course, the programs written to perform all of the functionality would already be written and typically pre-installed on the memory.

Note that the operations in FIG. 13 can be performed in any order.

Figure 14:
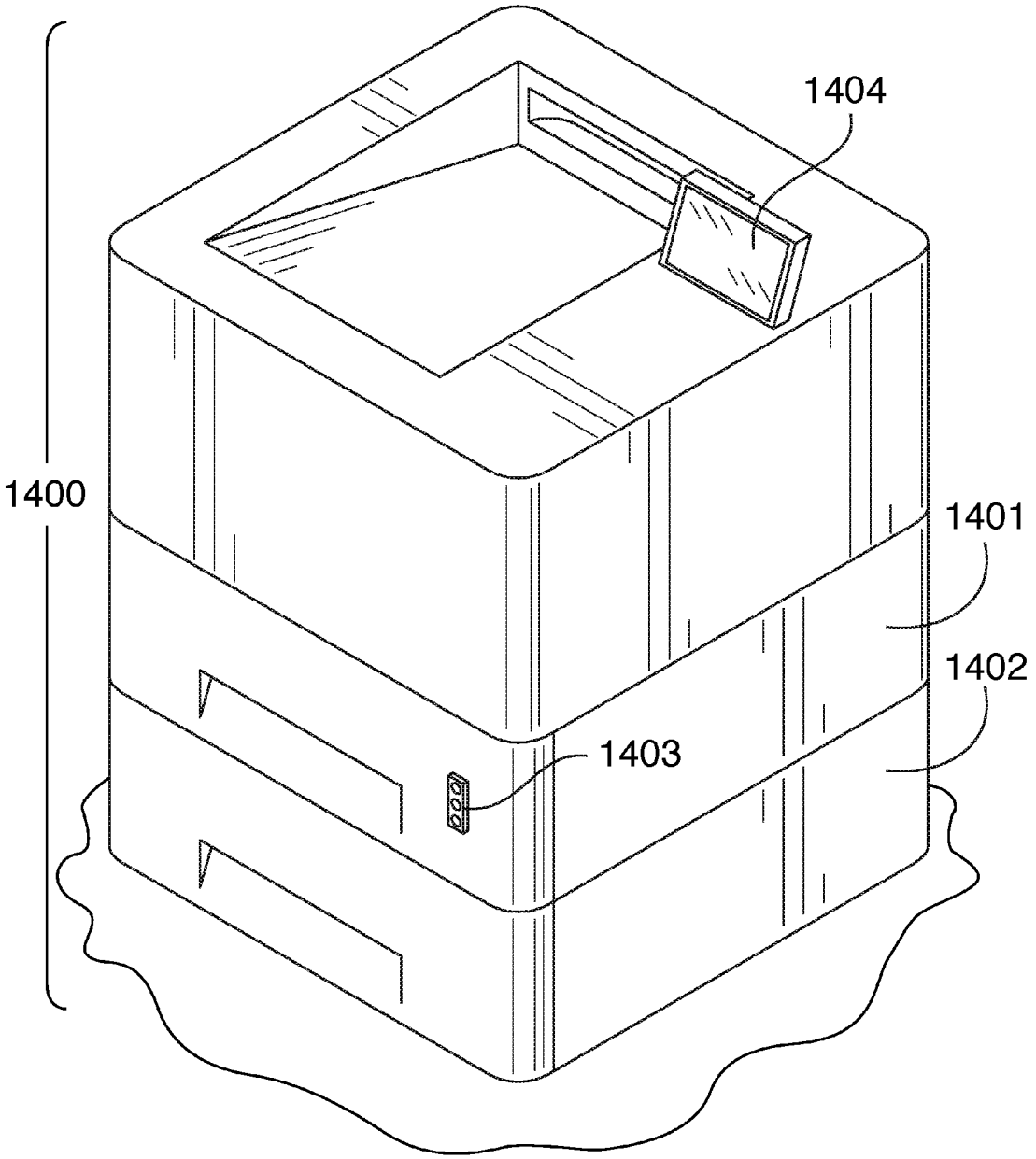
FIG. 14 is a drawing of a secure tray printer, according to an embodiment.

FIG. 14 is a drawing of a secure tray printer, according to an embodiment.

A secure printer 1400 has a secure tray 1401 (which slide into a latch assembly), a tray sensor and all other associated structures of a secure tray as described herein in order to apply all of the security features described herein to the secure tray. A non-secure tray 1402 does not have the latch assembly and tray sensor and functions as a standard printer without regard for security modes and features. Thus, valuable paper would of course be put into the secure tray 1401 while non-valuable paper would be put into non-secure tray 1402. The non-secure tray 1402 typically cannot be locked and can always be removed and printed to (subject to any other restrictions, such as typically a printer will not print to a tray if there is no paper in the tray).

A light pipe 1403 amplifies three LEDs (although any other number of LEDs) that are behind the light pipe 1403 and installed on the secure printer 1400 itself and aligned with the light pipe 1403. The output device 110 can be the three LEDs. As long as the upper tray (the secure tray 1401) is installed inside the secure printer 1400, then one can see the status of the secure printer (e.g., what mode the secure printer 1400 is in, any errors that occurred etc.) by which LEDs are light (or flashing) on the light pipe 1403. The processor 100 controls which of the three LEDs on the output device 110 are actually lit up, and each LED on the secure printer 1400 corresponds to one of the positions on the light pipe 1403. In this way, the upper tray itself does not need to have any electronic display on it, as what is displayed on the light pipe 1403 is essentially generated from LEDs (output device 110) installed (embedded) on the secure printer 1400 behind the light pipe. When the upper tray (the secure tray) is removed, then the real LEDs are visible on the secure printer 1400. The light pipe 1403 can be three clear transparent pieces of glass or plastic so that the LEDs behind the light pipe are visible.

A standard display 1404 is used to control the printer (e.g., change settings, clean print heads, adjust Wi-Fi configuration, etc.) In the manufactured secure tray printer, the light pipe 1403 can be optional and all outputs with regard to the security features of the printer (e.g., the mode it is in, errors generated, etc.) can be displayed on the standard display 1404.

Figures 15A, 15B:
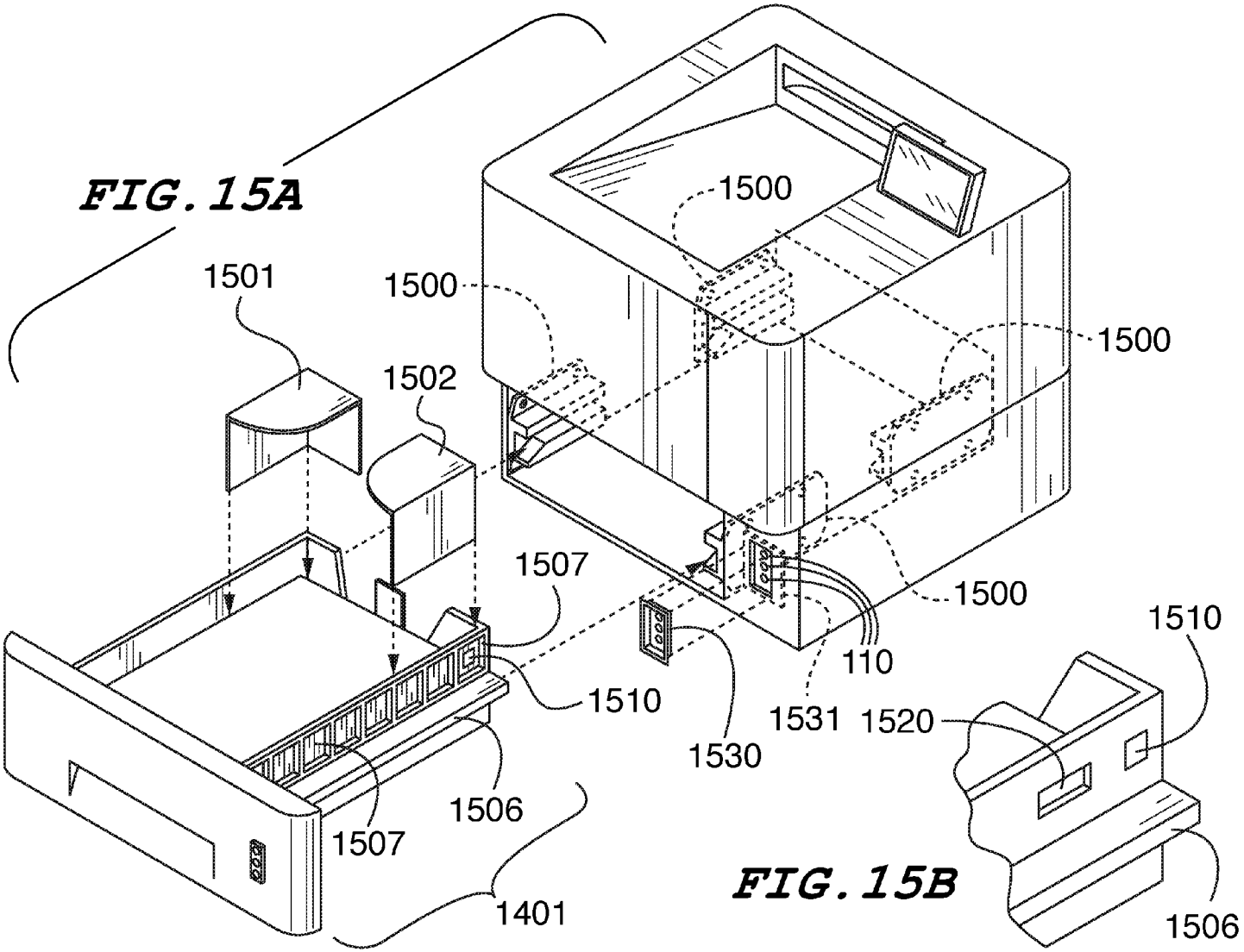
FIG. 15A is a drawing of a standard printer being converted into a secure tray printer, according to an embodiment.
FIG. 15B is a drawing of a side of a secure tray, according to an embodiment.

FIG. 15A is a drawing of a standard printer being converted into a secure tray printer, according to an embodiment.

A standard printer can be converted to a secure printer, as described herein. The standard printer has four rail guides 1500 which are used to receive the tray (the tray slides into all four rail guides). A left corner shield 1501 and a right corner shield 1502 are inserted over the paper 1504 so that a person cannot attempt to reach in behind the secure tray 1401 and access the paper 1504. The left corner shield 1501 and the right corner shield 1502 can be made out of hard plastic or any suitable material. The secure tray 1401 has two rails 1506 (one on each side of the secure tray) which slide into the rail guides 1500.

In order to convert the standard printer into a secure printer, one (or more) of the four rail guides 1500 will be removed and replaced with a latch assembly (and other structures as described herein). Note that the other side of the secure tray not shown in FIG. 15 can look the same as the side shown (identical structure).

A striker plate 1507 is either naturally on the side of the secure tray or can be a separate plate that can be installed (e.g., attached via glue, nails, or other attachment mechanism) to the right (and/or the left) side of the secure tray. The striker plate 1507 has a set of notches (also referred to as ribs) to which the latch 901 can extend into (in the latch extended position) and hence lock the secure tray inside the secure printer. The striker plate 1507 shown has eight notches, although of course it can have any number of notches (even just one). What is important is that there is a notch that coincides with the location of the latch 901 (which is fixed in location inside the latch assembly) so that when the secure tray is fully pushed into the printer, the latch extends it locks onto (into) the notch, thereby preventing physical removal of the secure tray. Each notch thus must have sufficient depth in order for the latch 901 to have enough thickness to "grab onto" to prevent removal of the secure tray when the latch is extended.

A detectable object 1510 (such as a magnet, RFID chip, etc.) is affixed (e.g., with glue, other adhesive, or other affixing mechanism) on the side of the secure tray and can be detected by the tray sensor when the 102 when the secure tray is fully pushed into its shelf. The shelf being defined by the respective guides (the latch tray assembly guide and the rail guides). In the manufactured secure tray printer embodiment, the secure tray would already come with the detectable object on its side in the appropriate position to line up with the tray sensor.

The light pipe 1403 on the secure tray 1401 illuminates the LEDs (the output device 110) on the secure printer. A light pipe frame 1530 fits into the printer and in front of the output device 110. Behind the output device 110 would be a printed circuit board (PCB) 1531 which houses the processor 100 and any associated components including the connectors connecting the processor 100 to the other parts of the system.

FIG. 15B is a drawing of a side of a secure tray, according to an embodiment.

In a further embodiment, a side of the secure tray can have only one notch 1520 which coincides with the latch when the secure tray is fully inserted into the secure printer so that the secure tray cannot be removed when the latch 901 is extended into the notch 1520. Latch assemblies can exist on one or both sides of the secure tray, but there must be a corresponding notch for each latch assembly. Only one latch assembly is really required for proper operation of the secure system (in other words, the other three original rail guides can remain after the conversion process). The detectable object 1510 can be a magnet, RFID chip, or any other object that can be detectable by a detector which is the tray sensor 102. Of course the tray sensor 102 must be the appropriate detector for the type of detectable object being used (e.g., if the detectable object is a magnet then the tray sensor should be a Hall sensor (or Hall Effect sensor) or other type of magnet detector).

Figure 16:
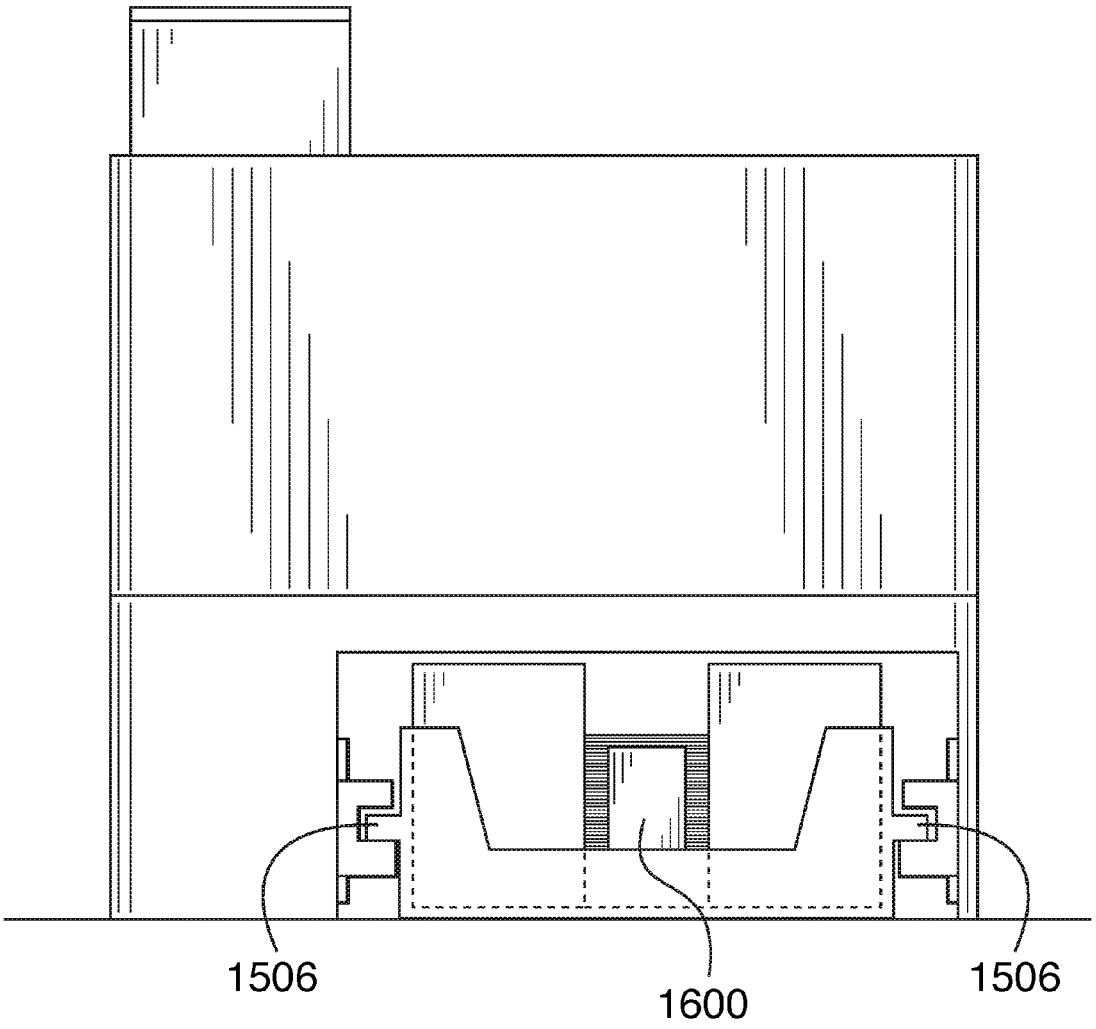
FIG. 16 is a drawing of rear view of a secure tray printer, according to an embodiment.

FIG. 16 is a drawing of rear view of a secure tray printer, according to an embodiment.

Shown is the left corner shield 1501, the right corner shield 1502, and a backstop 1600. The backstop 1600 can be made of the same material as the left corner shield 1501 and the right corner shield 1502 and also serves to prevent someone from trying to access the paper from the rear of the printer.

FIG. 17A is a drawing of a latch assembly and its latch solenoid, arm and spring, according to an embodiment.

A latch assembly 1700 comprises a latch solenoid 109, a plunger 1702, a spring 1703, and a linkage 1704. The linkage 1704 has a hollow eye 1705. When energized, the latch solenoid 109 will retract the plunger towards the latch solenoid 109. When de-energized the latch solenoid 109 will relax and the spring 1703 will push the plunger 1702 back away from the latch solenoid in its resting (natural) position (the default position which corresponds to the extended position). No energy is required (but for the energy from the spring 1703) to put the plunger 1702 in the default position. The latch solenoid 109 can attach to the latch assembly 1700 via adhesive or any other attachment mechanism. A plunger pin 1710 is at the end of the plunger 1702 and the plunger pin can rotate (pivot) inside the plunger 1702. A slot 1711 on the plunger 1702 allows for the motion of the linkage 1704.

FIG. 17B is an enlarged view of the latch solenoid and linkage, according to an embodiment. Note that the eye 1705 of the linkage 1704 is a hex, meaning that the latch arm axle 1800 (which has round ends but has a hex-shaped body as illustrated in FIG. 18) cannot rotate freely inside the eye 1705.

FIG. 18 is a drawing of the latch assembly and a latch arm axle, according to an embodiment.

A latch arm axle 1800 slides through a top hole 1801 in the latch assembly 1700, then through the eye 1705 in the linkage 1704, then through a ridge hole 1803 in a ridge 1804 and then through a latch hole 1805 in a latch 901 and then finally through a bottom hole 1807 in the latch assembly 1700. Note that the ridge hole 1803 has a slightly larger diameter than the top hole 1801 and the bottom hole 1807 because the latch arm axle 1800 is hex shaped at the point where it passes through the ridge 1804 hence the ridge hole 1803 diameter is slightly larger to accommodate rotation of the hex portion of the latch arm axle 1800. The upper part and lower part of the latch arm axle 1800 are both round (not hex) which fit into the top hole 1801 and bottom hole 1807 respectively. The latch arm axle 1800 keeps these pieces all together yet allows the linkage 1704 to move/pivot around the latch arm axle 1800. A latch arm flag 902 is connected to the latch arm 1810 which is connected to the latch 901.

When the latch solenoid 109 is energized, the plunger 1702 causes the linkage 1704 to move and pivot around the latch arm axle 1800 and hence turn the latch arm axle 1800. The linkage 1704 when moved will turn the latch arm axle 1800 which in turn moves the latch arm (along with the latch arm flag 902) and hence the latch 901. The latch arm axle 1800 would rotate freely within the top hole 1801, the ridge hole 1803, and bottom hole 1807. The latch arm axle 1800 does not rotate freely inside the eye 1705 of the linkage 1704 because the eye 1705 is hex shaped. The latch arm axle 1800 does not rotate freely inside the latch arm 1810 but instead the latch arm axle 1800 is integrally connected inside a latch hole 1805 through the latch arm 1810 ((because the latch hole 1805 in the latch arm 1810 is also hex shaped) so that when the latch arm axle 1800 turns it would turn the latch arm 1810 (and hence move the latch 901).

The latch arm flag 902 will move along with the latch arm 1810. The latch arm 1810 and latch 901 can be considered different locations on the same object. The latch arm flag 902 is attached to the latch arm 1810 and is basically an extension of it for use with the latch sensor 112.

Thus, the latch assembly enables energization of the latch solenoid 109 which causes movement of the linkage 1704 which causes the latch arm axle 1800 to turn which turns the latch arm 1810 and thus the latch 901. Turning the latch arm axle 1800 in one direction can cause the latch 901 to be in the extended position (See FIG. 24, de-energization of the latch solenoid), and turning the latch arm axle 1800 in the opposite direction would cause the latch 901 to be in the retracted position (see FIG. 26, energization of the latch solenoid).

Figure 19:
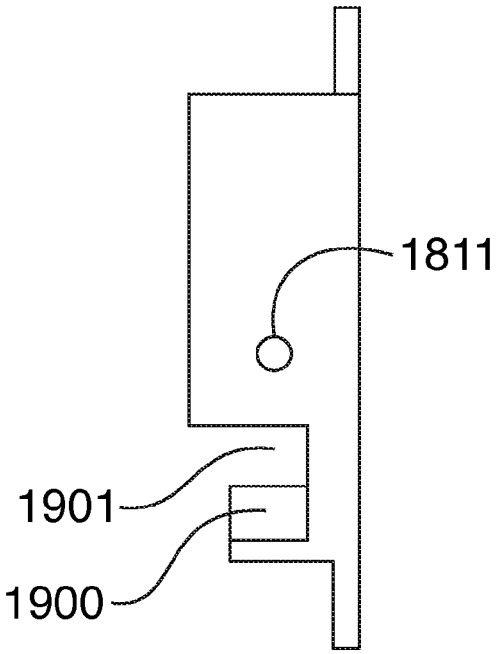
FIG. 19 is a drawing of a front view of the latch assembly, according to an embodiment.

FIG. 19 is a drawing of a front view of the latch assembly, according to an embodiment.

A latch assembly guide 1901 is used to guide a rail of the secure tray into the latch assembly (in the same manner that the rail guide would do so). A ramp 1900 guides a rail up into the latch assembly guide 1901.

A controller cable access hole 1811 is a hole in the latch assembly which can be used to pass any cables/connectors through. This is also visible in FIG. 18.

Figure 20:
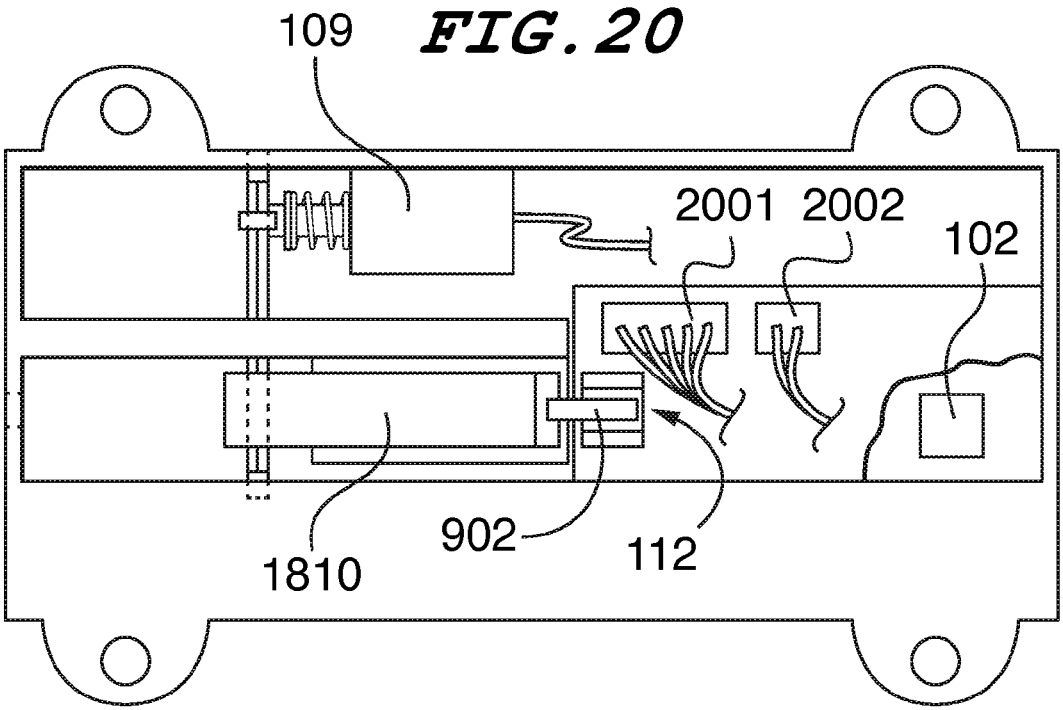
FIG. 20 is a drawing of a side view of the latch assembly, according to an embodiment.
Figure 21:
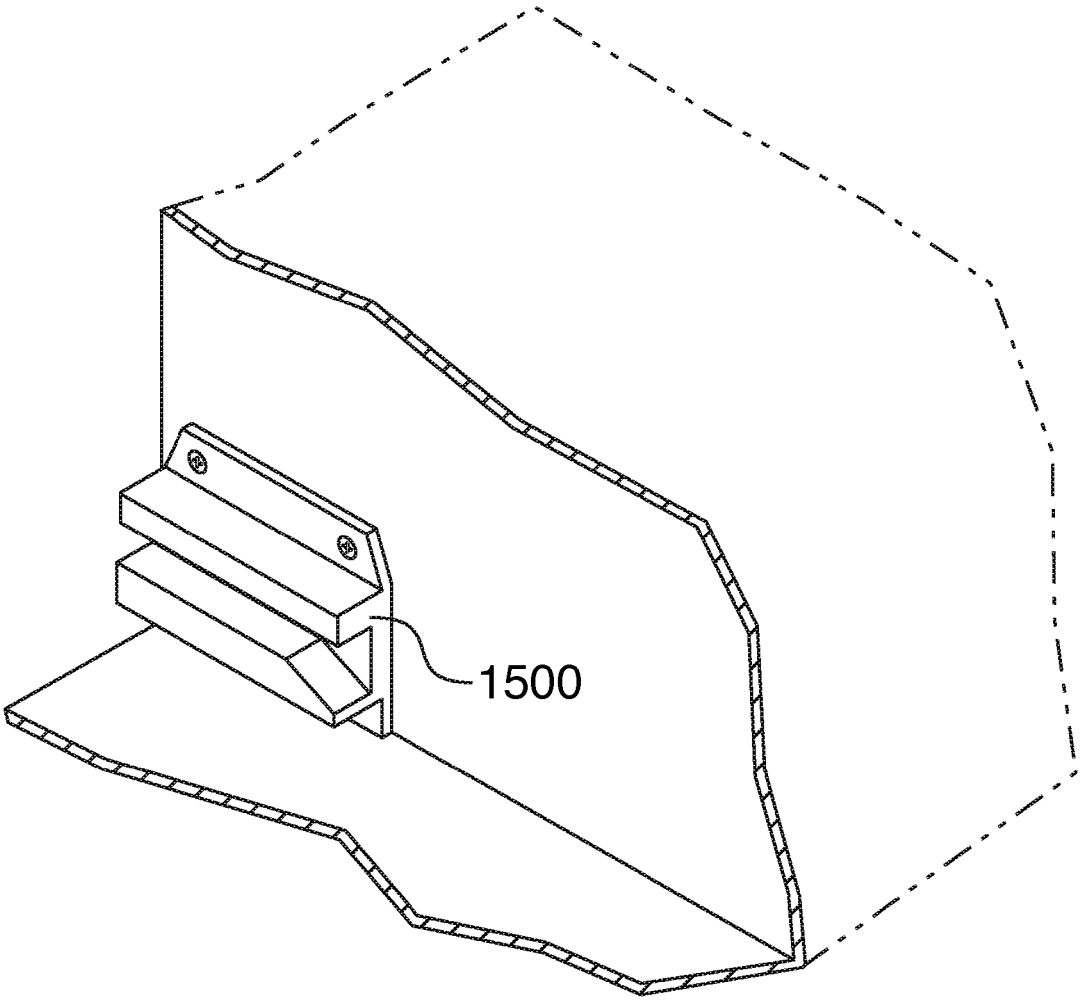
FIG. 21 is a drawing of a rail guide on a standard printer, according to an embodiment.

FIG. 20 is a drawing of a side view of the latch assembly, according to an embodiment.

The latch 901 is in the extended position, because the latch solenoid 109 is not energized because the spring 1703 is not compressed (hence it is in the default position). The latch sensor 112 is shown which is able to detect the presence (and also the absence) of the latch arm flag 902. The latch sensor 112 can be a photo interrupter which uses a light source and a light sensor to detect whether something is in the path of the light source or not. If the light source (light beam) is detected, then it is determined that the latch arm flag 902 is not present and hence the latch 901 is in the retracted position. If the light source is not detected, then it is determined that the latch arm flag 902 is present and hence the latch 901 is in the extended position. In the case of FIG.

20, the latch arm flag 902 is indeed present inside the latch sensor 112 and hence the latch 901 is in the extended (locked) position.

A first latch connector 2001 connects the latch processor 101 to the latch solenoid 109, and a second latch connector 2002 connects the latch processor 101 to the processor 100.

A tray sensor 102 is a sensor used to detect a detectable object. For example, the tray sensor 102 can be a hall sensor and the detectable object can be a magnet installed on the proper location on the secure tray, which is detected by the hall sensor. An appropriate signal can be transmitted to the latch processor 101 indicating detection (or non-detection) of the detectable object. Alternatively, the tray sensor 102 can be an RFID reader and the detectable object can be an RFID marker on the proper location on the secure tray. Not shown in FIG. 20 is the latch processor 101 (located on printed circuit board on the latch assembly where the connectors 2001, 2002 are located) and the wires connecting the tray sensor 102 to the latch processor 101.

FIG. 21 is a drawing of a rail guide on a standard printer, according to an embodiment.

Shown is a rail guide 1500 present on the standard printer. What will be illustrated is converting a standard printer into a secure tray printer.

Figure 22:
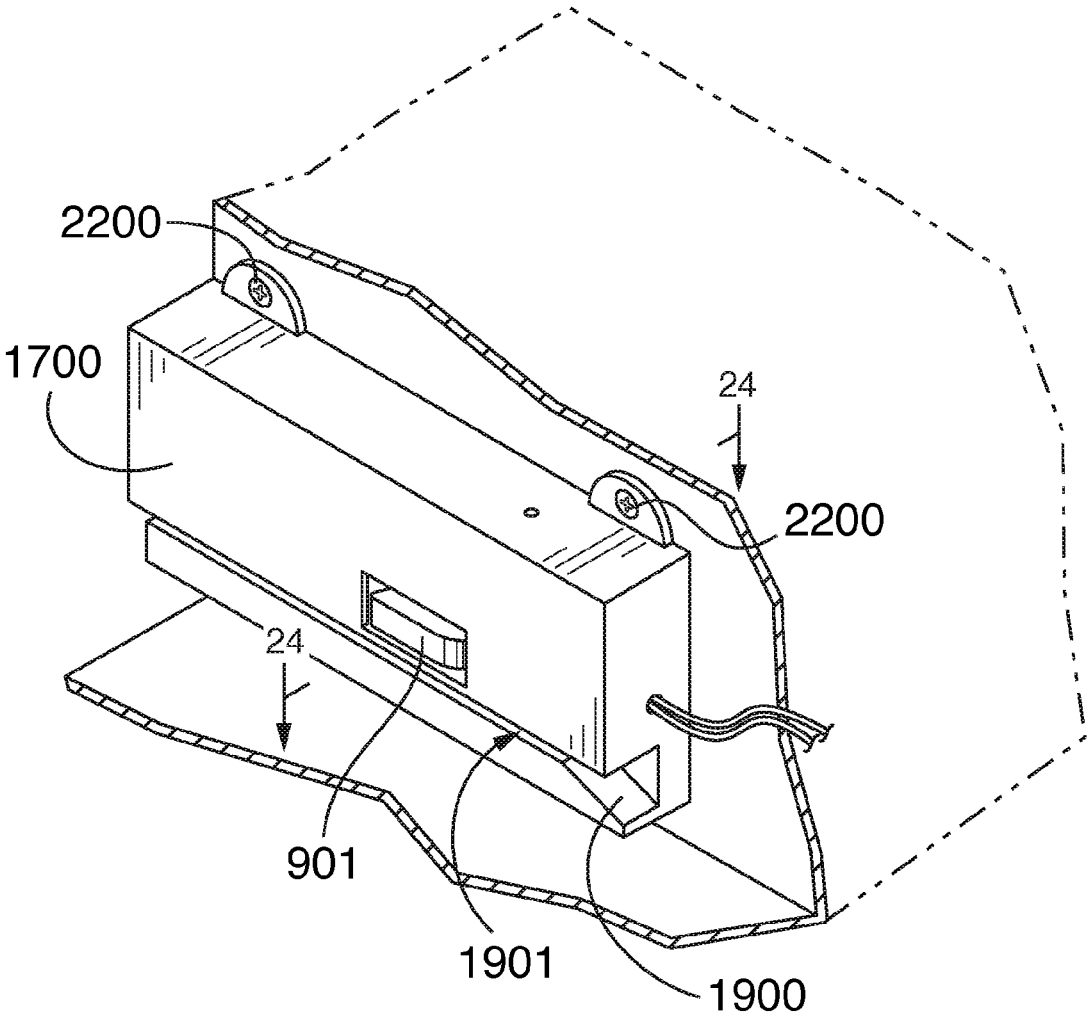
FIG. 22 is a drawing of a latch assembly installed on a printer replacing the rail guide, according to an embodiment.

FIG. 22 is a drawing of a latch assembly installed on a printer replacing the rail guide, according to an embodiment.

After the rail guide 1500 is removed, a latch assembly 1700 is installed on the printer thereby replacing the rail guide 1500. Note that the latch assembly 1700 in FIG. 22 is installed with screws 2200, although any other attachment mechanism can be used to install the latch assembly 1700 on the printer. The latch assembly 1700 should be installed in the same position as the rail guide 1500 that was removed, so that the rails of the secure tray 1506 would slide through the latch assembly guide 1901 in the latch assembly 1700 in the same manner as it slid through the removed rail guide 1500. A ramp 1900 allows the rail of the secure tray to slide up the ramp and into the latch assembly guide 1901.

Typically, a printer (standard or secure) would have four rail guides. In one embodiment, only one of the rail guides 1500 needs to be replaced with a latch assembly 1700. In another embodiment, more than one (e.g., 2, 3, or all 4) rail guides can be placed with latch assemblies of the kind of latch assembly 1700. However, the secure printer works well with only one latch assembly 1700 installed.

In FIG. 22, the latch 901 is in the retracted position, enabling the secure tray to be slid through the latch assembly 1700 and out of the secure printer. In one embodiment, the latch assembly 1700 can be attached to the secure printer using screws, although of course any other attachment mechanism can be used.

Figure 23:
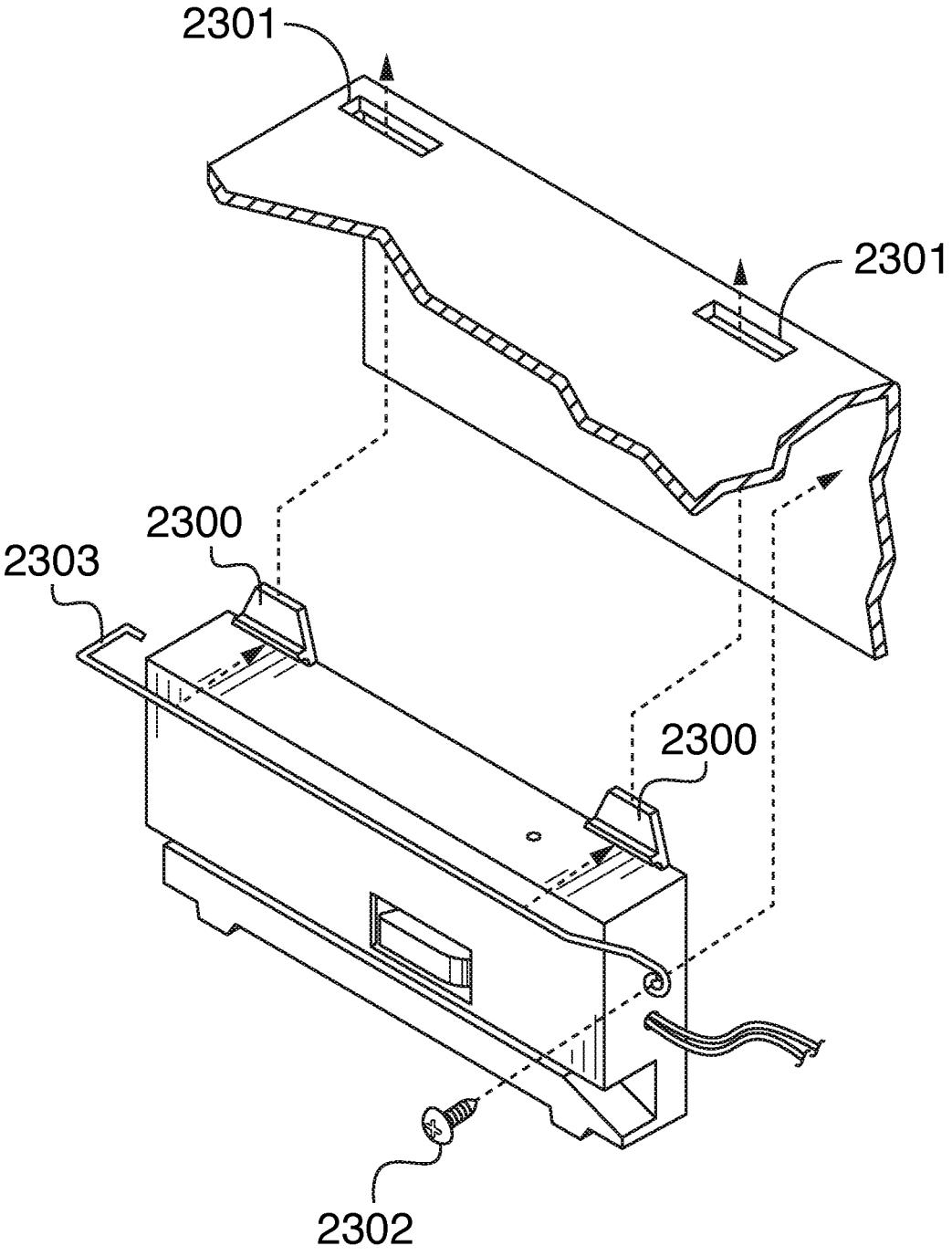
FIG. 23 is a drawing showing one method of installation of a latch assembly onto a printer according to an embodiment.

FIG. 23 is a drawing showing one method of installation of a latch assembly onto a printer according to an embodiment.

The latch assembly 1700 is installed via latch assembly mounting tabs 2300 that fit into latch assembly mounting holes 2301 on the printer. A screw 2302 screws through a loop in a support wire 2303 (that is a stiff wire which is used to support mounting of the latch assembly to the printer) and into the printer. An end of the support wire 2303 fits into a hole (not visible in FIG. 23 in an end of the latch assembly).

Figure 24:
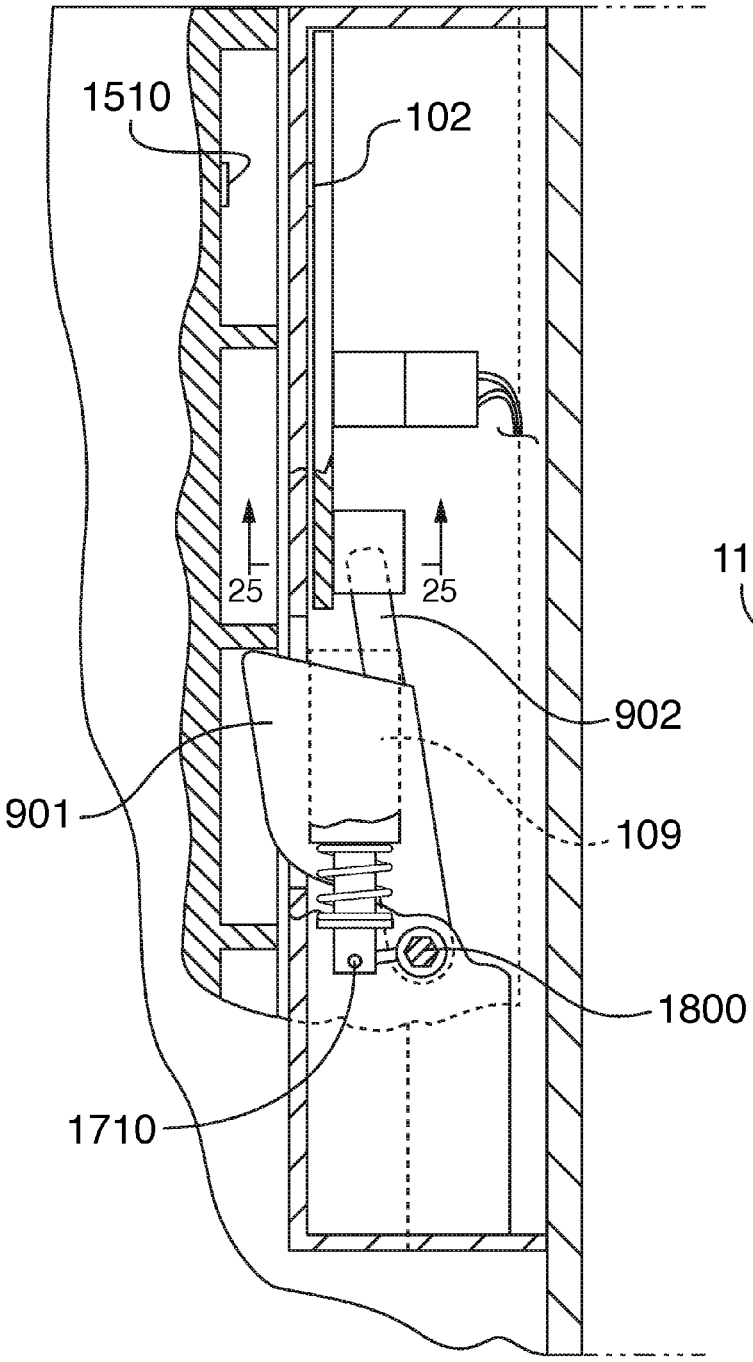
FIG. 24 is a cross sectional view of the latch assembly in the locked position looking down from the plane shown in FIG. 22, according to an embodiment.

FIG. 24 is a cross sectional view of the latch assembly in the locked position looking down from the plane shown in FIG. 22, according to an embodiment.

Note that the latch solenoid 109 is not energized and so the spring 1703 urges the plunger into the extended position (away from the latch solenoid 109), which in turn causes the latch 901 to be in the extended position. The latch in the extended position locks into a notch on the side of the secure tray and hence prevent removal of the secure tray.

Latch arm axle 1800 is fixed in position inside the latch assembly but can rotate to extend and retract the latch 901.

Note that the tray sensor 102 is aligned with the detectable object 1510 so that the detectable object 1510 would be detected by the tray sensor 102 (and such signal would be transmitted to the processor 100).

Figure 25:
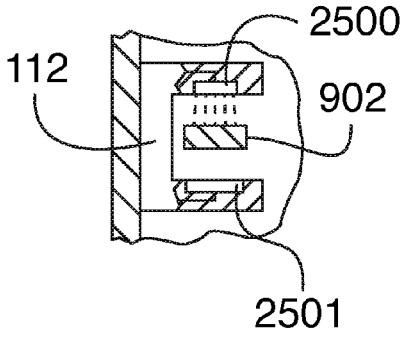
FIG. 25 is a cross section view of the latch sensor looking up from the plane shown in FIG. 24, according to an embodiment.

FIG. 25 is a cross section view of the latch sensor looking up from the plane shown in FIG. 24, according to an embodiment. The latch is in the extended (expanded) position, which is the default position the spring 1703 pushes the latch to (without energization to the latch solenoid 109).

The latch sensor 112 is shown. Note that the latch arm flag 902 is between the light source 2500 and the light detector 2501 and hence blocks the light beam coming from the light source 2500. Since the light detector 2501 does not detect the light source 2500, then it is determined that the latch 901 is expanded/extended (locked).

Figure 26:
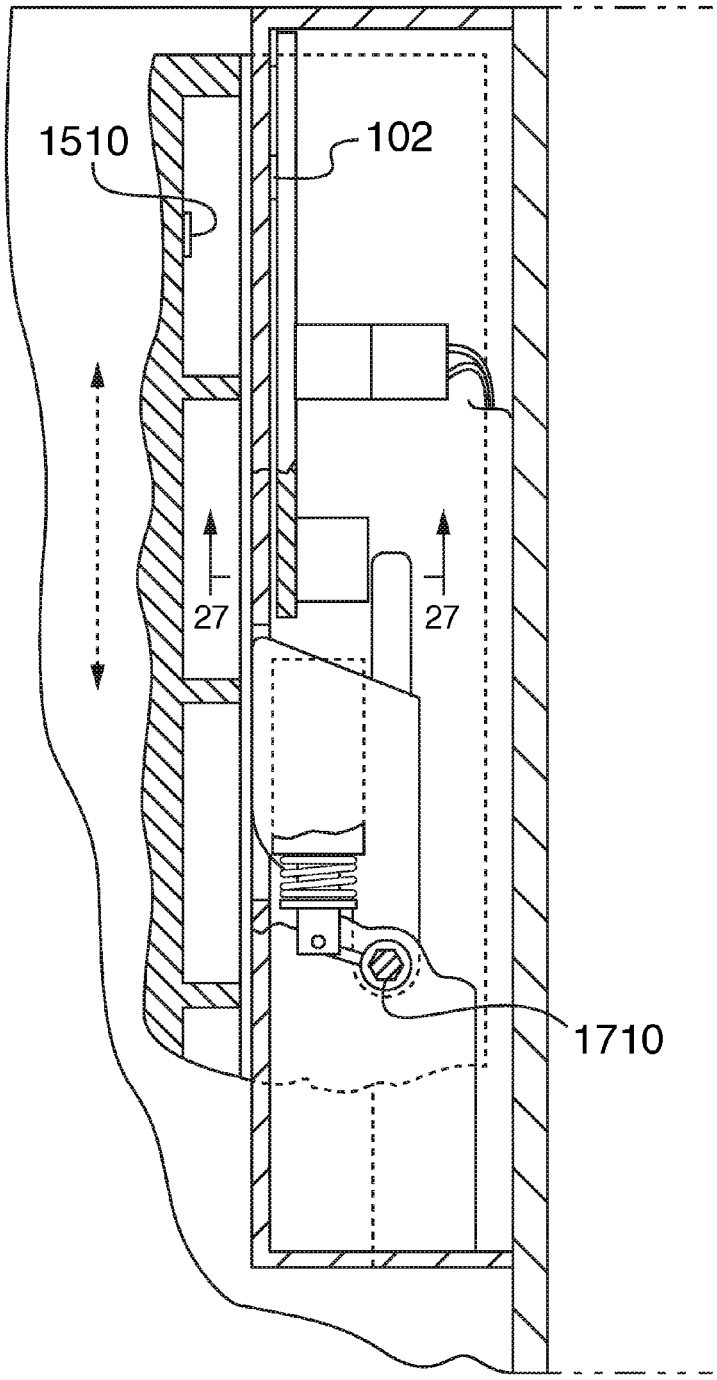
FIG. 26 is a cross sectional view of the latch assembly in the unlocked position looking down from the plane shown in FIG. 22, according to an embodiment.

FIG. 26 is a cross sectional view of the latch assembly in the unlocked position looking down from the plane shown in FIG. 22, according to an embodiment. This is the same view as in FIG. 24 (the view plan marked as '24' in FIG. 22 but with the latch in the retracted position).

The latch is in the retracted position because the latch solenoid is energized which goes against the natural force of the spring 1703. The plunger is retracted into the latch solenoid thereby 109 turning the latch arm axle 1800 which turns the latch arm and hence the latch 901 is retracted (unlocked).

Compare the plunger pin 1710 in FIG. 24 with the plunger pin 1710 in FIG. 26. The plunger pin 1710 can rotate inside the plunger 1702 to reflect the motion of the plunger. Note that the latch arm axle 1800 can rotate freely inside the top hole 1801, ridge hole 1803, and bottom hole 1807. When the latch solenoid 109 is energized (as shown in FIG. 26), the plunger 1702 retracts and pulls the linkage 1704 towards the latch solenoid 109 which causes the linkage 1704 to turn the latch arm axle 1800 which turns the latch arm 1810 and hence the latch into the retracted (unlocked) position. The opposite process happens in reverse, when the latch solenoid is de-energized (as shown in FIG. 24), the spring pushes the plunger 1702 away from the latch solenoid which then causes the linkage 1704 to turn the latch arm axle 1800 in the opposite direction which turns the latch arm 1810 and hence the latch into the extended (locked) position.

Note that in FIG. 26 the secure tray is not fully pushed inside the printer, this is evident because the tray sensor 102 is not aligned with the detectable object 1510 but the detectable object 1510 is offset somewhat from the tray sensor 102. As such, the tray sensor 102 would not detect the detectable object 1510 in this position.

Figure 27:
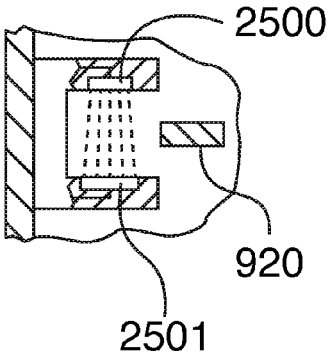
FIG. 27 is a cross sectional view of the latch sensor looking up from the plane shown in FIG. 26, according to an embodiment.

FIG. 27 is a cross sectional view of the latch sensor looking up from the plane shown in FIG. 26, according to an embodiment.

The light source 2500 shines the light beam to the light detector 2501. Since the latch arm flag 902 is not blocking the light beam from the light source 2500, the light detector detects the light beam and hence it is determined that the latch is in the retracted mode (unlocked). The latch processor 101 can receive the signal from the light sensor and transmit a signal representing the state (latch arm retracted or not) to the processor 100. This can be used to check for errors.

Note that when the secure tray is removed and the latch is retracted, the secure tray can always be re-inserted through the latch assembly guides back into the printer. Note that when the secure tray is removed and the latch is extended, the secure tray can still be re-inserted because pushing the secure tray through the latch assembly guide will push the extended latch into the retracted position (overcoming the force of the spring).

Note that while the particular mechanics of opening and closing the latch are illustrated in FIGS. 17, 18, 20, 24-26, it can be appreciated that different mechanisms can be utilized to effectuate the end goal of locking in a secure tray inside a secure printer when in a certain mode which is designed to prevent removal of the secure tray. For example, instead of a solenoid other components can be used, such as a relay, switch, valve, motor, etc. ultimately, the end result is that based on a signal from the controller processor, a latch can be locked (securing the secure tray therein) and released (enabling the secure tray to be removed). Similarly, in a mode which prohibits printing from the secure tray, a respective pickup roller for the secure tray (or any other mechanism required for printing to that tray) would be disabled, while in a mode which allows printing from the secure tray the respective pickup roller for the secure tray (or any other such mechanism required for printing to that tray) would be enabled.

Note that all of the parts described herein can be constructed from any suitable material, such as plastic, any type of metal, aluminum, steel, or any material known in the art that is known to be used for the respective part.

The word connected as used herein does not require a direct connection but there can be one or more intermediate connections (physical or wireless) between the connected elements. For example, if component A is stated as being connected to component B, it does not necessarily require a direct electrical contact between A and B, only that there are one or more intermediate pathways in which a signal from A can reach B and vice-versa. The same can be true of physical components, if physical component X is stated as being connected to physical component Y, it does not necessarily mean that X is physically attached to Y but there can be one or more intermediate parts therebetween.

All electrical components described herein will have their respective connectors (e.g., wires, cables, etc.) connecting them to their respective connections and power supplies, regardless of whether these are illustrated or not in the Figures.

One of the embodiments described herein is a conversion embodiment, in which a standard (non-secure) printer can be converted into a secure printer by adding the features described herein. It can be appreciated that the manufactured secure tray printer can have any and all of the features herein such that the secure printer is initially manufactured to include such features so they do not have to be added on later.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A printer, comprising:

a secure tray configured for insertion into the printer, the secure tray comprising a notch on a side of the secure tray;

a printing mechanism configured to, upon receiving a print command print on a sheet of paper picked from the secure tray;

a latch assembly comprising a latch, the latch structured to have an extended position extending into the notch thereby locking the secure tray inside the printer when the secure tray is fully inside the printer, and the latch also structured to have a retracted position not extending into the notch thereby enabling removal of the secure tray from the printer when the secure tray is fully inside the printer, wherein the latch is structured to enable the secure tray to push the latch from the extended position into the retracted position upon insertion of the secure tray into the printer thereby enabling insertion of the secure tray when the latch is initially in the extended position;

a transceiver connected to a controller processor, the transceiver configured to receive wireless signals; and the controller processor configured that upon receipt of a particular wireless command by the transceiver, causes the latch to retract into the retracted position from the extended position.

2. The printer as recited in claim 1, wherein the latch assembly further comprises:

a solenoid configured to cause the latch to extend and retract.

3. The printer as recited in claim 2, wherein the latch assembly further comprises a spring structured to urge the latch to default to the extended position.

4. The printer as recited in claim 2, wherein the latch assembly further comprises a latch arm flag attached to the latch configured to move along with the latch.

5. The printer as recited in claim 4, wherein the latch assembly further comprises a latch sensor configured to detect presence and absence of the latch arm flag.

6. The printer as recited in claim 5, wherein the latch sensor is connected to the controller processor.

7. The printer as recited in claim 2, further comprising a latch processor configured to command the solenoid to energize which causes the latch to be in the retracted position and de-energize which causes the latch to be in the extended position, the latch processor being in communication with the controller processor.

8. The printer as recited in claim 7, wherein the latch processor is configured to require an encrypted command from the controller processor before the latch processor causes the solenoid to energize.

9. The printer as recited in claim 1, further comprising a detectable object located on the side of the secure tray and a tray sensor configured to detect the detectable object.

10. The printer as recited in claim 9, wherein the tray sensor is connected to the controller processor, and the controller processor is further configured such that when the detectable object is not detected by the tray sensor then printing from the secure tray is disabled.

11. The printer as recited in claim 10, wherein the controller processor is further configured such that the printing from the secure tray is disabled by disabling a pickup roller associated with the secure tray.

12. The printer as recited in claim 1, further comprising a fob which comprises a plurality of buttons, the fob configured to transmit the particular wireless command upon a particular button or combination of buttons out of the plurality of buttons being pressed.

13. The printer as recited in claim 1, further comprising an LED display connected to the controller processor comprising a plurality of LEDs, the controller processor further configured to illuminate a particular set of LEDs out of the plurality of LEDs based on a current mode of the printer with the current mode being in a set of possible modes which comprises a refuse mode and an accept mode, wherein the refuse mode does not allow paper to be drawn from the secure tray, and the accept mode allows for printing from the secure tray.

14. The printer as recited in claim 1, further comprising valuable paper located inside the secure tray.

15. A printer, comprising:

a secure tray fully inserted into the printer, the secure tray comprising a notch on a side of the secure tray;

a printing mechanism configured to, upon receiving a print command, print on a sheet of paper picked from the secure tray;

a latch assembly comprising a latch, the latch structured to have an extended position extending into the notch thereby locking the secure tray inside the printer and a retracted position not extending into the notch thereby enabling removal of the secure tray from the printer;

a transceiver connected to a controller processor, the transceiver configured to receive wireless signals;

the controller processor configured that upon receipt of a particular wireless command by the transceiver, causes the latch to retract into the retracted position from the extended position; and a left corner shield located at a left rear inside of the secure tray and a right corner shield located at a right rear inside of the secure tray.

16. The printer as recited in claim 15, further comprising a backstop located at a center rear inside of the secure tray.

17. The printer as recited in claim 15, further comprising a fob which comprises a plurality of buttons, the fob configured to transmit the particular wireless command upon a particular button or combination of buttons out of the plurality of buttons being pressed.

18. The printer as recited in claim 15, further comprising valuable paper located inside the secure tray.

19. A printer, comprising:

a secure tray fully inserted into the printer, the secure tray comprising a notch on a side of the secure tray;

a printing mechanism configured to, upon receiving a print command, print on a sheet of paper picked from the secure tray;

a latch assembly comprising a latch, the latch structured to have an extended position extending into the notch thereby locking the secure tray inside the printer and a retracted position not extending into the notch thereby enabling removal of the secure tray from the printer;

a transceiver connected to a controller processor, the transceiver configured to receive wireless signals;

the controller processor configured that upon receipt of a particular wireless command by the transceiver, causes the latch to retract into the retracted position from the extended position; and a non-secure tray which has no locking mechanism and the printer is configured to enable printing from the non-secure tray when printing is prevented to the secure tray.

20. The printer as recited in claim 19, further comprising a fob which comprises a plurality of buttons, the fob configured to transmit the particular wireless command upon a particular button or combination of buttons out of the plurality of buttons being pressed.

21. The printer as recited in claim 19, further comprising valuable paper located inside the secure tray.

22. A printer, comprising:

a secure tray fully inserted into the printer, the secure tray comprising a notch on a side of the secure tray;

a printing mechanism configured to, upon receiving a print command, print on a sheet of paper picked from the secure tray;

a latch assembly comprising a latch, the latch structured to have an extended position extending into the notch thereby locking the secure tray inside the printer and a retracted position not extending into the notch thereby enabling removal of the secure tray from the printer;

a transceiver connected to a controller processor, the transceiver configured to receive wireless signals; and the controller processor configured that upon receipt of a particular wireless command by the transceiver, causes the latch to retract into the retracted position from the extended position, wherein the controller processor is connected to a paper pick actuator configured to enable and disable operation of a pickup roller for the secure tray, the controller processor configured to disable the pickup roller when the printer is in a first mode of operation, the controller processor configured to enable the pickup roller when the printer is in a second mode of operation.

23. The printer as recited in claim 22, further comprising a fob which comprises a plurality of buttons, the fob configured to transmit the particular wireless command upon a particular button or combination of buttons out of the plurality of buttons being pressed.

24. The printer as recited in claim 22, further comprising valuable paper located inside the secure tray.

25. A printer, comprising:

a secure tray fully inserted into the printer, the secure tray incorporating a locking mechanism having a locked state preventing removal of the secure tray from the printer and an unlocked state enabling removal of the secure tray from the printer;

a printing mechanism configured to, upon receiving a print command, print on a sheet of paper picked from the secure tray;

a transceiver;

a controller processor connected to the transceiver and the printing mechanism, the controller processor configured to read and execute computer readable instructions from a computer readable storage medium, the computer readable instructions programmed to cause the controller processor to:

implement a refuse mode by default, the refuse mode preventing the printing mechanism from printing from the secure tray;

change modes from the refuse mode to an accept mode when a particular wireless command is received, the accept mode enabling printing from the secure tray; and change modes from the accept mode to the refuse mode when a specific wireless command is received.

26. The printer as recited in claim 25, wherein the computer readable instructions are further programmed to change the secure tray from the locked state to the unlocked state when a certain wireless command is received.

27. The printer as recited in claim 25, wherein the locking mechanism comprises a latch assembly comprising a latch, the latch structured to have an extended position extending into a notch on the secure tray thereby locking the secure tray inside the printer in the locked state and a retracted position not extending into the notch thereby enabling removal of the secure tray from the printer in the unlocked state.

28. The printer as recited in claim 27, wherein the computer readable instructions are further programmed to change the latch from the extended position to the retracted position when a certain wireless command is received.

29. The printer as recited in claim 25, wherein the printer further comprises a pickup roller associated with the secure tray, wherein the computer readable instructions are further programmed such that the refuse mode disables the pickup roller.

30. The printer as recited in claim 25, further comprising a fob which comprises a plurality of buttons, the fob configured to transmit the particular wireless command upon a particular button or particular combination of buttons out of the plurality of buttons being pressed, and the fob configured to transmit the specific wireless command upon a specific button or specific combination of buttons out of the plurality of buttons being pressed.

31. The printer as recited in claim 25, further comprising valuable paper located inside the secure tray.

32. A method to convert a printer to a secure printer, comprising:

providing the printer;

installing a controller processor on the printer;

removing at least one rail guide from the printer;

installing at least one latch assembly in place of the at least one rail guide;

connecting a latch assembly cable between the latch assembly and the controller processor;

connecting a transceiver to the controller processor; and installing a secure tray which comprises a detectable object on a side of the secure tray.

33. The method as recited in claim 32, further comprising inserting valuable paper inside the secure tray.

* * * * *